US009534308B2

(12) United States Patent
Chua et al.

(10) Patent No.: US 9,534,308 B2
(45) Date of Patent: Jan. 3, 2017

(54) PROTECTING ANODES FROM PASSIVATION IN ALLOY PLATING SYSTEMS

(71) Applicant: Novellus Systems, Inc., Fremont, CA (US)

(72) Inventors: Lee Peng Chua, Beaverton, OR (US); Steven T. Mayer, Lake Oswego, OR (US); David W. Porter, Sherwood, OR (US); Thomas A. Ponnuswamy, Sherwood, OR (US)

(73) Assignee: Novellus Systems, Inc., Fremont, CA (US)

( * ) Notice: Subject to any disclaimer, the term of this patent is extended or adjusted under 35 U.S.C. 154(b) by 785 days.

(21) Appl. No.: 13/902,517

(22) Filed: May 24, 2013

(65) Prior Publication Data

US 2013/0334052 A1 Dec. 19, 2013

Related U.S. Application Data

(60) Provisional application No. 61/655,930, filed on Jun. 5, 2012.

(51) Int. Cl.
*C25D 21/18* (2006.01)
*C25D 5/00* (2006.01)
(Continued)

(52) U.S. Cl.
CPC ..... *C25D 5/00* (2013.01); *C25D 17/001* (2013.01); *C25D 17/002* (2013.01); *C25D 17/10* (2013.01);
(Continued)

(58) Field of Classification Search
CPC ..... C25D 17/002; C25D 21/18
See application file for complete search history.

(56) References Cited

U.S. PATENT DOCUMENTS 2,511,395 A * 6/1950 Baier ..... C25D 3/60 205/101
3,450,605 A 6/1969 McGivern, Jr.
(Continued)

FOREIGN PATENT DOCUMENTS

CA 2 391 038 2/2001
CN 101307482 A 11/2008
(Continued)

OTHER PUBLICATIONS

U.S. Appl. No. 61/502,590, filed Jun. 29, 2011, entitled "Electrodeposition with Isolated Cathode and Regenerated Electrolyte".
(Continued)

*Primary Examiner* — Bryan D. Ripa
(74) *Attorney, Agent, or Firm* — Weaver Austin Villeneuve & Sampson LLP

(57) ABSTRACT

An apparatus for continuous simultaneous electroplating of two metals having substantially different standard electrodeposition potentials (e.g., for deposition of Sn—Ag alloys) comprises an anode chamber for containing an anolyte comprising ions of a first, less noble metal, (e.g., tin), but not of a second, more noble, metal (e.g., silver) and an active anode; a cathode chamber for containing catholyte including ions of a first metal (e.g., tin), ions of a second, more noble, metal (e.g., silver), and the substrate; a separation structure positioned between the anode chamber and the cathode chamber, where the separation structure substantially prevents transfer of more noble metal from catholyte to the anolyte; and fluidic features and an associated controller coupled to the apparatus and configured to perform continuous electroplating, while maintaining substantially constant concentrations of plating bath components for extended periods of use.

12 Claims, 14 Drawing Sheets

(51) Int. Cl.

| | |
|---|---|
| ***C25D 21/06*** | (2006.01) |
| ***C25D 17/00*** | (2006.01) |
| ***C25D 17/10*** | (2006.01) |
| *C25D 3/60* | (2006.01) |

(52) U.S. Cl.
CPC ..... *C25D 21/06* (2013.01); *C25D 21/18* (2013.01); *C25D 3/60* (2013.01)

(56) References Cited

U.S. PATENT DOCUMENTS

| | | | | |
|---|---|---|---|---|
| 4,111,772 | A | 9/1978 | Horn | |
| 4,330,377 | A | 5/1982 | Franks, Jr. | |
| 4,459,185 | A | 7/1984 | Obata et al. | |
| 4,565,609 | A | 1/1986 | Nobel et al. | |
| 4,828,657 | A | 5/1989 | Fukuoka et al. | |
| 4,944,851 | A | 7/1990 | Cordani et al. | |
| 5,039,576 | A | 8/1991 | Wilson | |
| 5,162,079 | A | 11/1992 | Brown | |
| 5,194,141 | A | 3/1993 | Suganuma et al. | |
| 5,312,539 | A | 5/1994 | Thomson | |
| 5,403,460 | A | 4/1995 | Sala et al. | |
| 5,409,582 | A | 4/1995 | Wimbish et al. | |
| 5,518,957 | A | 5/1996 | Kim | |
| 5,785,833 | A | 7/1998 | Vaughan | |
| 5,883,762 | A | 3/1999 | Calhoun et al. | |
| 6,063,172 | A | 5/2000 | Bokisa et al. | |
| 6,120,673 | A | 9/2000 | Reiter et al. | |
| 6,126,798 | A | 10/2000 | Reid et al. | |
| 6,251,255 | B1 | 6/2001 | Copping et al. | |
| 6,391,179 | B1 * | 5/2002 | Ogawa | C25D 17/10 204/226 |
| 6,527,920 | B1 | 3/2003 | Mayer et al. | |
| 6,569,299 | B1 | 5/2003 | Reid et al. | |
| 6,800,187 | B1 | 10/2004 | Reid et al. | |
| 6,821,407 | B1 | 11/2004 | Reid et al. | |
| 6,878,258 | B2 | 4/2005 | Kovarsky | |
| 6,890,416 | B1 | 5/2005 | Mayer et al. | |
| 6,899,803 | B2 | 5/2005 | Matejat et al. | |
| 7,195,702 | B2 | 3/2007 | Bokisa, Sr. et al. | |
| 7,273,540 | B2 | 9/2007 | Sonoda et al. | |
| 8,128,791 | B1 | 3/2012 | Buckalew et al. | |
| 9,404,194 | B2 | 8/2016 | Mayer et al. | |
| 2003/0000842 | A1 | 1/2003 | Matejat et al. | |
| 2003/0150736 | A1 | 8/2003 | Kovarsky | |
| 2004/0000491 | A1 | 1/2004 | Kovarsky et al. | |
| 2004/0217005 | A1 | 11/2004 | Rosenfeld et al. | |
| 2004/0245113 | A1 | 12/2004 | Bokisa, Sr. et al. | |
| 2005/0062169 | A1 | 3/2005 | Dubin et al. | |
| 2005/0121317 | A1 | 6/2005 | Klocke et al. | |
| 2005/0133374 | A1 | 6/2005 | Kovarsky et al. | |
| 2006/0062169 | A1 | 3/2006 | Suzuki et al. | |
| 2006/0081478 | A1 | 4/2006 | Sahoda et al. | |
| 2006/0144712 | A1 | 7/2006 | Klocke | |
| 2010/0032310 | A1 | 2/2010 | Reid et al. | |
| 2010/0116674 | A1 * | 5/2010 | Luo | C25D 3/30 205/101 |
| 2010/0147679 | A1 | 6/2010 | Feng et al. | |
| 2011/0226614 | A1 | 9/2011 | Rash et al. | |
| 2012/0000786 | A1 | 1/2012 | Mayer et al. | |
| 2012/0138471 | A1 | 6/2012 | Mayer et al. | |
| 2012/0164341 | A1 | 6/2012 | Hakiri | |

FOREIGN PATENT DOCUMENTS

| | | | | |
|---|---|---|---|---|
| CN | 101476150 | A | 7/2009 | |
| CN | 101855390 | A | 10/2010 | |
| EP | 0 048 579 | | 12/1984 | |
| EP | 2 471 977 | A2 | 7/2012 | |
| GB | EP 0048579 | A1 * | 3/1982 | C25D 3/56 |
| JP | S58-144495 | A | 8/1983 | |
| JP | 04-024440 | | 4/1992 | |
| JP | 11-021692 | | 1/1999 | |
| JP | 2000-219993 | | 8/2000 | |
| JP | 2004-183091 | | 7/2004 | |
| WO | WO 99/25902 | | 5/1999 | |
| WO | WO 2005/116303 | | 12/2005 | |

OTHER PUBLICATIONS

U.S. Appl. No. 61/775,409, filed Mar. 8, 2013, entitled "Electroplating System with Separated Anode Chamber".

US Office Action, dated Oct. 8, 2014, issued in U.S. Appl. No. 13/305,384.

US Final Office Action, dated Apr. 23, 2015 issued in U.S. Appl. No. 13/305,384.

US Notice of Allowance, dated Mar. 28, 2016 issued in U.S. Appl. No. 13/305,384.

Chinese First Office Action dated Jun. 1, 2015 issued in CN 2011-1040482.0.

Chinese Second Office Action dated Dec. 10, 2015 issued in CN 2011-1040482.0.

Taiwan Office Action and Search Report dated Sep. 4, 2015 issued in TW 100144031.

Taiwan Office Action and Search Report dated Jan. 26, 2016 issued in TW 100144031.

Chinese First Office Action dated Jul. 23, 2015 issued in CN 201310221399.1.

U.S. Appl. No. 15/198,787, filed Jun. 30, 2016, entitled "Electroplating Apparatus and Process for Wafer Level Packaging,".

* cited by examiner

PROTECTING ANODES FROM PASSIVATION IN ALLOY PLATING SYSTEMS

CROSS-REFERENCE TO RELATED APPLICATIONS

This application claims benefit under 35 U.S.C. §119(e) of U.S. Provisional Patent Application No. 61/655,930, filed Jun. 5, 2012 and titled "METHOD OF PROTECTING ANODE FROM PASSIVATION IN ALLOY PLATING SYSTEMS WITH LARGE REDUCTION POTENTIAL DIFFERENCES", which is incorporated herein by reference in its entirety and for all purposes.

BACKGROUND

Electrochemical deposition processes are well-established in modern integrated circuit fabrication. The movement from aluminum to copper metal lines in the early years of the twenty-first century drove a need for more sophisticated electrodeposition processes and plating tools. Much of the sophistication evolved in response to the need for ever smaller current carrying lines in device metallization layers. These copper lines are formed by electroplating the metal into very thin, high-aspect ratio trenches and vias using a methodology commonly referred to as "damascene" processing.

Electrochemical deposition is now poised to fill a commercial need for sophisticated packaging and multichip interconnection technologies known generally as wafer level packaging (WLP) and through silicon via (TSV) electrical connection technology. These technologies present their own very significant challenges.

For example, these technologies require electroplating on a significantly larger feature size scale than most damascene applications. For various types of packaging features (e.g., TSV through chip connections, redistribution wiring, fan-out wiring, or flip-chip pillars), plated features are frequently, in current technology, greater than about 2 micrometers and typically 5-100 micrometers in height and/or width (for example, pillars may be about 50 micrometers). For some on-chip structures such as power busses, the feature to be plated may be larger than 100 micrometers. The aspect ratios of the WLP features are typically about 1:1 (height to width) or lower, while TSV structures can have very high aspect ratios (e.g., in the neighborhood of about 10:1 to 20:1).

Given the relatively large amount of material to be deposited, plating speed also differentiates WLP and TSV applications from damascene applications. Currently copper depositions rates of about 2.5 micrometers/minute are employed and solder plating rates of 3-5 micrometers/minute are used. In the future these rates are anticipated to increase to as high as 3.5 micrometers/min and 6 micrometers/min respectively. Further, independent of the plating rate, the plating must be conducted in a global and locally uniform manner on the wafer, as well as from one wafer to the next.

Still further, electrochemical deposition of WLP features may involve plating various combinations of metals such as the layered combinations or alloys of lead, tin, indium, silver, nickel, gold, palladium and copper.

While meeting each of these challenges, WLP electrofill processes must compete with conventionally less challenging and potentially less inexpensive pick and place (e.g. solder ball placement) or screen printing operations.

SUMMARY

An apparatus for continuous simultaneous electroplating of two metals having substantially different standard electrodeposition potentials (e.g., for deposition of Sn—Ag alloys) comprises an anode chamber for containing an anolyte comprising ions of a first, less noble metal, (e.g., tin), but not of a second, more noble, metal (e.g., silver) and an active anode; a cathode chamber for containing catholyte including ions of a first metal (e.g., tin), ions of a second, more noble, metal (e.g., silver), and the substrate; a separation structure positioned between the anode chamber and the cathode chamber, where the separation structure substantially prevents transfer of more noble metal from catholyte to the anolyte; and fluidic features and an associated controller coupled to the apparatus and configured to perform continuous electroplating, while maintaining substantially constant concentrations of plating bath components for extended periods of use.

One aspect of the disclosure pertains to apparatus for simultaneous electroplating a first metal and a second metal onto a substrate. The second metal is more noble than the first metal; that is, it has more positive electroreduction potential. As an example, the first metal is tin and the second metal is silver. The apparatus may be characterized by the following features: (a) an anode chamber for containing anolyte and an active anode (the active anode contains the first metal); (b) a cathode chamber for containing catholyte and the substrate; (c) a separation structure positioned between the anode chamber and the cathode chamber and permitting passage of ionic current during electroplating; and (d) a getter containing a solid phase getter material that undergoes disproportionation when contacting ions of the second metal. In certain embodiments, the getter is positioned to contact the anolyte but not contact the catholyte during electroplating. In certain embodiments, the getter is positioned at a first distance from the cathode chamber, the active anode is positioned at a second distance from the cathode chamber, the first distance is greater than the second distance. In various implementations, the getter is structurally distinct from the active anode.

In some examples, the separation structure includes an ion selective membrane. For example, the separation structure may include a cationic membrane configured for allowing transport of protons, water, and ions of the first metal from the anolyte to the catholyte during electroplating. In some designs, the apparatus additionally includes a source of silver ions fluidically coupled to the cathode chamber. The active anode may constructed of tin such as low alpha tin.

The getter may be disposed at various locations in the apparatus. In one approach, the apparatus includes an anolyte circulation loop fluidically coupled to the anode chamber and designed or configured to flow the anolyte through the anode chamber. In such design, the anolyte circulation loop may include the getter, and the getter is located outside the anode chamber. In some cases, the apparatus also includes a circuit for connecting the active anode to the getter. In another approach, the getter includes a filter having a wound structure containing the getter material. The filter may be designed or configured such that the anolyte flows through the wound structure when in operation.

In another example, where the apparatus includes an anolyte circulation loop, the getter is positioned between a location for the active anode and the inlet to the anode chamber. Such apparatus may additionally include a spacer for separating the getter and active anode from physical contact during electroplating. In another approach, the getter material is housed in gettering chamber during electroplating, and the gettering chamber is located in the anode chamber and in contact with the separation structure.

In some implementations, the apparatus additionally includes a detection probe for detecting the second metal in the anolyte. The leak detection probe may include the getter material configured to serve as an electrode.

In some examples, the getter material is low alpha tin metal. In some examples, the getter is electrically isolated from the active anode. In some examples, the getter material is made of particles with a surface area per volume at least about 2 times the surface area per volume of the active anode.

Another aspect of the disclosure pertains to methods of simultaneous electroplating onto a substrate a first metal and a second metal, with the second metal being more noble than the first metal. As an example, the first metal may be tin or low alpha tin and the second metal may be silver. Such methods may be characterized by the following operations: (a) flowing anolyte through an anode chamber containing an active anode of the first metal; (b) flowing catholyte through a cathode chamber containing the substrate (the anode chamber is separated from the cathode chamber by a separation structure that permits passage of ionic current during electroplating); and (c) contacting the anolyte with a getter containing a solid phase getter material that undergoes disproportionation when contacting ions of the second metal. The getter may be positioned to contact the anolyte but not contact the catholyte during electroplating. The getter may be positioned at a first distance from the cathode chamber, while the active anode is positioned at a second distance from the cathode chamber, and the first distance is greater than the second distance. Further, the getter may be structurally distinct from the active anode.

In some implementations, a method additionally includes delivering silver ions to the catholyte. In some designs, the separation structure includes an ion selective membrane such as a cationic membrane that allows transport of protons, water, and ions of the first metal from the anolyte to the catholyte during electroplating.

In some methods, the anolyte flows through an anolyte circulation loop fluidically coupled to the anode chamber and contacts the getter disposed in the anolyte circulation loop. Such methods may additionally include flowing current through a circuit connecting the getter material and the active anode while contacting the anolyte with the getter. In some cases, the getter in the circulation loop is provided in a filter having a wound structure including the getter material. The anolyte flows through the wound structure.

In some implementations, the anolyte flows through an anolyte circulation loop as described, and the getter is positioned between the active anode and the inlet to the anode chamber. In such implementations, the getter may be physically separated from the active anode by a spacer. In some designs, the getter is disposed in a gettering chamber located in the anode chamber and in contact with said separation structure.

Some methods may additionally include detecting the second metal in the anolyte using a leak detection probe comprises the getter material configured to serve as an electrode. In some methods, the getter material itself may be a low alpha tin metal. The getter material may include particles with a surface area per volume at least about 2 times the surface area per volume of the active anode.

Another aspect of the disclosure pertains to a leak detection probe for detecting the presence of metal ions in a tin ion containing electrolyte. The metal ions to be detected are of a metal more noble than tin and may be detected at concentrations in the range of about 50 ppm or higher. The leak detection probe may be characterized by the following elements: (a) a first electrode containing substantially tin metal (e.g., low alpha tin metal); (b) a second electrode containing substantially a second metal more noble than tin (e.g., silver or porous silver); and an electrically insulating separator positioned between the two electrodes and configured to have the tin ion containing electrolyte flow through it and contact the second electrode during operation. In some designs, the probe includes a resistor electrically connecting the first electrode and the second electrode, such that voltage across the resistor may be employed to detect the presence of the metal ions in the tin ion containing electrolyte. In some designs, the probe has an impedance of between about 10 ohm and 1 ohm.

In some embodiments, the first electrode is a rod centrally disposed in the leak detection probe, where the electrically insulating separator is disposed around at least a portion of the perimeter of the central anode rod, and the second electrode is disposed around at least a portion of an outer perimeter of the electrically insulating separator. In some related designs, the electrically insulating separator fully encircles the perimeter of the central anode rod, and wherein the silver electrode fully encircles the outer perimeter of the electrically insulating separator. Further, in some designs, the electrically insulating separator extends over a portion of the axial length of the central anode rod, and an electrical insulator is disposed around the central anode rod in a region not covered by the electrically insulating separator.

In some embodiments, the electrically insulating separator includes sintered plastic or glass. The entire probe may be sized to be removably integrated with a separated anode chamber or in an anolyte circulation loop.

These and other features of the disclosed embodiments will be presented in further detail below with reference to the associated drawings.

DETAILED DESCRIPTION

Introduction

Figure 1A:
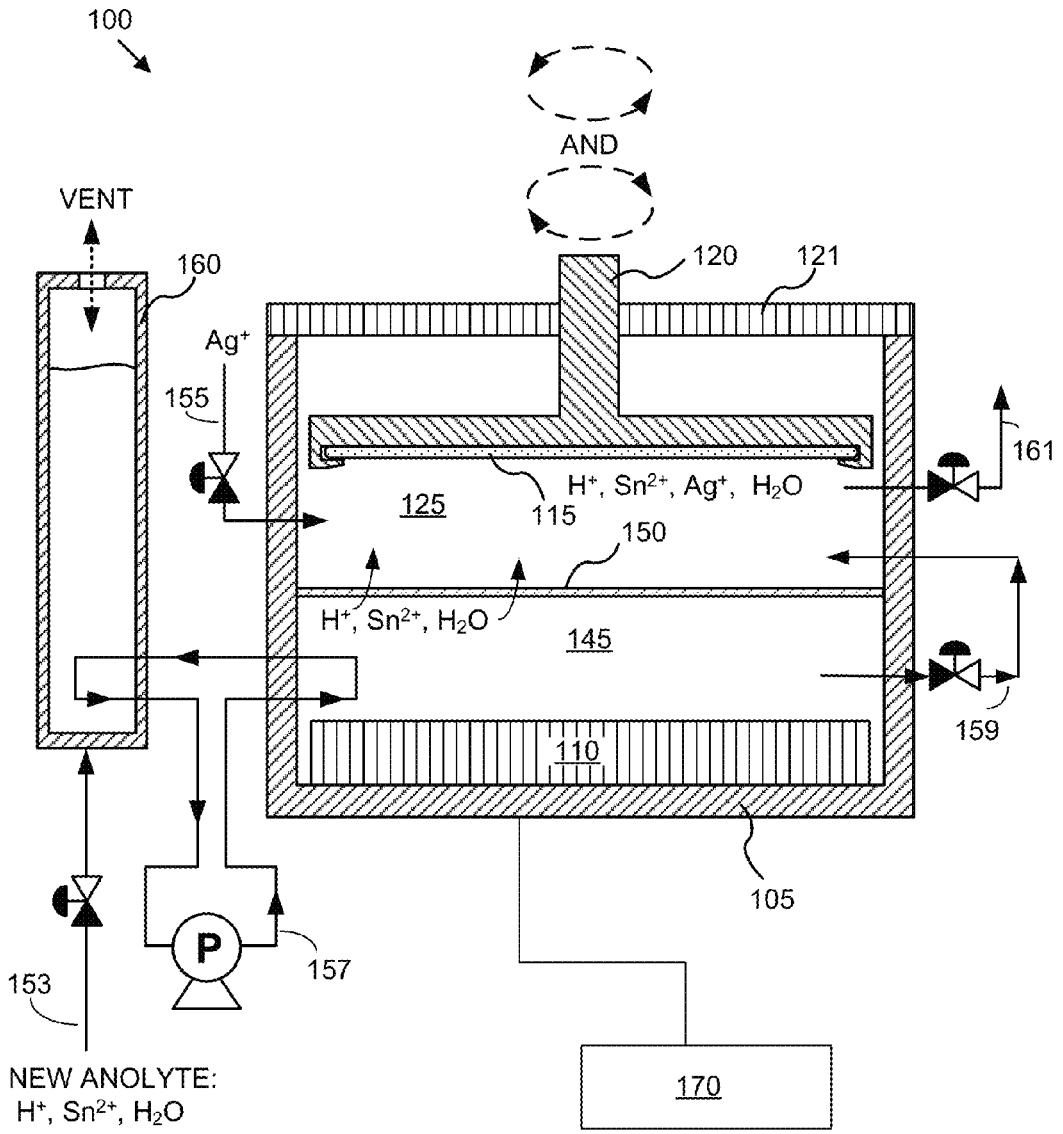
FIG. 1A is a diagrammatic cross-sectional view of an embodiment of an electroplating apparatus in accordance with the present disclosure.

In alloy electroplating systems, where one or more of the metal species has a significantly different reduction potential than another metal species, such as in SnAg (tin-silver) solder electroplating, formidable challenges exist in implementing a design employing an active anode (i.e., and metal anode that dissolves during electroplating). One of these challenges is an exchange/displacement reaction resulting in anode surface passivation. For example, the passivation of an anode having a significantly less noble metal (e.g., tin) may occur by the following displacement reaction, $Sn(s)+2Ag^{+}\rightarrow Sn^{2+}+2Ag(s)$, which, due to the large reduction potential differences of tin and silver, can occur quite readily. If silver coats the tin anode surface, it may make passage of current significantly more difficult and non-uniform. It may also generate unwanted particles, etc.

The present disclosure pertains to methods and apparatus using gettering to remove or "getter" unwanted reactive cations, $Ag^{+}$ in one embodiment, from a separated anode chamber (SAC), where the tin anode is housed. In a particular embodiment, the SAC compartment is substantially free of the more noble metal (e.g. silver) and separated from the cathode chamber containing catholyte. As explained below, the separation is typically accomplished by the using a cationic membrane whose properties provide a partial or nearly complete exclusion of noble metal from separated anode chamber. However, because perfect separation cannot always be ensured and because small leaks in the sealing members may occur, gettering is used to remove $Ag^{+}$ ions from the anolyte in a substantially continuous fashion, hence freeing or reducing the aforementioned passivation and other issues.

The disclosure also concerns an in-situ method of detecting $Ag^{+}$ contamination in the SAC compartment, which increases the reliability and robustness of the system and can be used to warn and thereby prevent the plating tool from running high value product wafer after a potential leak or some other source of contamination isolation failure between the two chambers.

Generally, the methods and apparatus provided herein are suitable for simultaneous electrodeposition of at least two metals having different electrodeposition potentials. These methods are particularly suited to depositing metals having a large difference in standard electrodeposition potentials, such as a difference of at least about 0.3 V, or at least about 0.5 V or more. These methods and apparatus will be illustrated using simultaneous electrodeposition of tin (less noble metal) and silver (more noble metal) as an example. The standard electrochemical potentials ($E_0$s) of tin and silver are separated by more than 0.9 volts ($Ag^{+}/Ag$: 0.8V NHE, $Sn^{+2}/Sn$: −0.15V). Stated another way, elemental silver is substantially more inert than elemental tin and therefore will electroplate out of solution first much more easily than tin.

It is understood that the provided apparatus and methods can also be used for simultaneous electrodeposition of other metal combinations (including alloys and mixtures), such as combinations of tin and copper, nickel and silver, copper and silver, indium and silver, iron and nickel, gold and indium, or two metal micro-mixtures such as gold and copper or copper and nickel. Electrodeposition of more than two metals can also be accomplished. For example, known ternary lead free alloys of tin, copper and silver, can be electrodeposited using methods and apparatus provided herein.

It is noteworthy that in some embodiments, low alpha tin is employed in the plating systems provided herein as a less noble metal. Low alpha tin is tin of extremely high chemical purity with low levels of alpha particle emitted (e.g. less than about 0.02 alpha emission counts per $cm^2$ per hour, or less than about 0.002 alpha emission counts per $cm^2$ per hour). This is significant for IC applications, because alpha emission in the semiconductor chips can cause reliability problems and can interfere with IC function. Accordingly, in some embodiments, the tin anode that is used in the provided apparatus contains low alpha tin. Further, in some embodiments, the electrolyte employs stannous ions that are low alpha tin grade. Low alpha tin in solution is a more expensive material (weight for weight) than metallic low alpha tin.

Electrochemical deposition may be employed at various points in the integrated circuit (IC) fabrication and packaging processes. At the IC chip level, damascene features are created by electrodepositing copper within vias and trenches to form multiple interconnected metallization layers. Above the multiple metallization layers, the "packaging" of the chip begins. Various wafer level packaging (WLP) structures may be employed, some of which contain alloys or other combinations of two or more metals or other components. For example, the packaging may include one or more "bumps" made from solder or related materials.

In a typical example of plated bump manufacturing, the processing starts with a substrate having a conductive seed layer (e.g., a copper seed layer) having an "underbump" diffusion barrier layer of plated nickel (e.g. about 1-2 μm thick and 100 μm wide) under a film of lead tin solder plated pillar (e.g., 50 to 100 microns thick and 100 microns wide). In accordance with certain methods provided herein the solder pillar is made of electrodeposited tin silver instead of lead tin. After plating, photoresist stripping, and etching of the conductive substrate copper seed layer, the pillars of solder are carefully melted or "reflowed" to create a solder "bumps" or balls attached to the underbump metal. An underbump of a non-solder high melting point plated metal solder "pedestal" such as copper, nickel, or a layered combination of these two, is often created below a solder film. In some processes, the pedestals are replaced with smaller and higher aspect ratio pillars of the high melting metals (e.g., nickel and/or copper) resulting in reduced use of solder. In this scheme, which is useful in achieving tight and precise feature pitch and separation control, the copper pillars may be, for example, 50 microns or less in width. Features can be separated from one another by 75-100 micron center to center, and the copper may be 20-40 microns in height. On top of the copper pillar, a nickel barrier film, e.g., about 1-2 microns thick, is sometimes deposited to separate the copper from the tin-containing solder and thereby avoid a solid state reaction of copper and tin which results in formation of various undesirable bronzes. Finally, a solder layer (conventionally a Sn—Pb layer, but a Sn—Ag layer according to certain embodiments) typically 20-40 microns in thickness is deposited. This scheme also enables a use of reduced amount of solder for the same feature sizes, reducing the cost of solder or reducing the total amount of lead in the chip. Recently, a move away from lead-containing solders has increased in momentum due to environmental and health safety concerns. Tin-silver solder alloy bumps are of particular interest and are used as an example to describe various embodiments described herein.

In chip and wafer level packaging, one method for forming the solder bumps is done by through-resist electroplating (other methods, typically now only used for larger features size/scales and prior device generations, include solder ball placement and slurry screen-paste-printing). Driven by the international lead-free industrial and environmental requirements, the industry has converged primarily to SnAg alloy solder material for electroplating lead free solders, usually at a composition close to the eutectic. The eutectic composition of silver in tin is at about 3.7 wt % silver, and, for example, typical compositions in use are between about 1.7-2.5% silver by weight. Thermodynamically, the eutectic alloy segregates into two phases, a silver rich phase ($Ag_3Sn$) and a nearly pure tin phase.

Due to the large difference in electrochemical reduction potential between tin and silver ions to pure metals, an active anode of a single metal (e.g., Sn) cannot be easily employed, at least in the conventional means of simply having a tin anode, because $Ag^+$ ions in the bath will very readily react with the tin anode: $2Ag^+ + Sn(s) \rightarrow 2Ag(s) + Sn^{2+}$, leading to (1) continuous depletion of silver ions in the bath, and associated stability issues (continual loss of $Ag^+$ and some small corresponding rise in $Sn^{2+}$) and, (2) anode passivation as the anodes become covered by Ag(s) material.

It has been seen that initially pure tin shot anodes changes appearance after being exposed to $Ag^+$. In one case, the silver was complexed and in another the silver was substantially uncomplexed (silver in a methane sulphonic acid solution without an additional complexing agent). The silver complexer used in this example was commercially available "SLG" (silver-ligand), at a concentration of about 120 ml/L. available from Mitsubishi Materials Corporation of Japan. Similar results are expected with various known thiol and dithiol compounds that serve as silver complexing agents. Examples of such known compounds include 3,6-dithiaoctane-1,8-diol. As observed, a black layer of film and sludge-slime material forms around the anode depending on conditions. In the presence of the complexer, the tin anode still reacts with the silver, however, the solution tends to not change color as significantly than when the complexer is present (yellowish, possibly indicating a reaction of the free silver in the solution or the container walls with stannous ion to form stannic ion). Both factors will eventually lead to poor on wafer performance, drift, degradation, and impractical short operational life. As a result, tin silver alloy electroplating systems commonly use of an inert anode design which decomposes the water in the electrolyte to form oxygen and release acid (protons).

The inert anode comes with certain disadvantages. Because tin is plated but is not generated at the anode, the inert anode design depletes tin from the solution, and therefore requires significant replenishment of $Sn^{2+}$ from liquid tin containing electrolyte (dosing) as compared to an active anode system (disclosed herein and also described in U.S. patent application Ser. No. 13/305,384, filed Nov. 28, 2011, titled ELECTROPLATING APPARATUS AND PROCESS FOR WAFER LEVEL PACKAGING, which is incorporated herein by reference for its disclosure of an active anode system for plating two metals).

Without going into extensive detail, $Sn^{2+}$ dosing in the inert anode configuration arises from the need to replenish the tin metal that has been plated-out on the wafer and from significant bleed and feed operation, required to maintain the bath at a constant concentration of its various constituents. Bleed and feed is necessitated by the fact that inert anode systems generate by-product acidic protons, and bath bleeding can control the bath acid concentration level. Unfortunately, the various components of the SnAg electroplating electrolyte are costly, due in large measure to the high cost of the low alpha tin electrolyte. The overall high cost is not due just to the sheer quantity of consumed electrolyte material, but also the particular type of tin (low alpha tin) required in electronics application. As explained, high energy alpha particles, from isotopes found even in trace amount in the manufactured tin, can lead to device "soft errors". Therefore, the semiconductor chip making industry requires that the tin used must be of low level alpha grade to avoid chip performance reliability issues from the aforementioned "alpha-particle-induced soft errors". In addition to the chemical balance issues noted above, inert anodes systems also have the issue of oxygen gas generation at the inert anode and the need to remove the bubbles from the plating reactor and blocking bubbles from reaching the wafer surface. Also, the continual introduction of oxygen into the system heightens the risk of forming $SnO_2$, also known in the industry as "stannic sludge." The later can lead to void defects in the solder bump formation, and weakened interfacial adhesion between the solder bump and the underlying metal layer. Finally, the potential magnitude of the oxygen evolving inert anode is very high, leading to the oxidation of bath additives and silver complexers, as well as direct oxidation of stannous to stannic form of tin, and other issues. Hence in an inert anode system, bath stability and life is shortened, which further adds to operational cost and reduces available up time.

Figure 2:
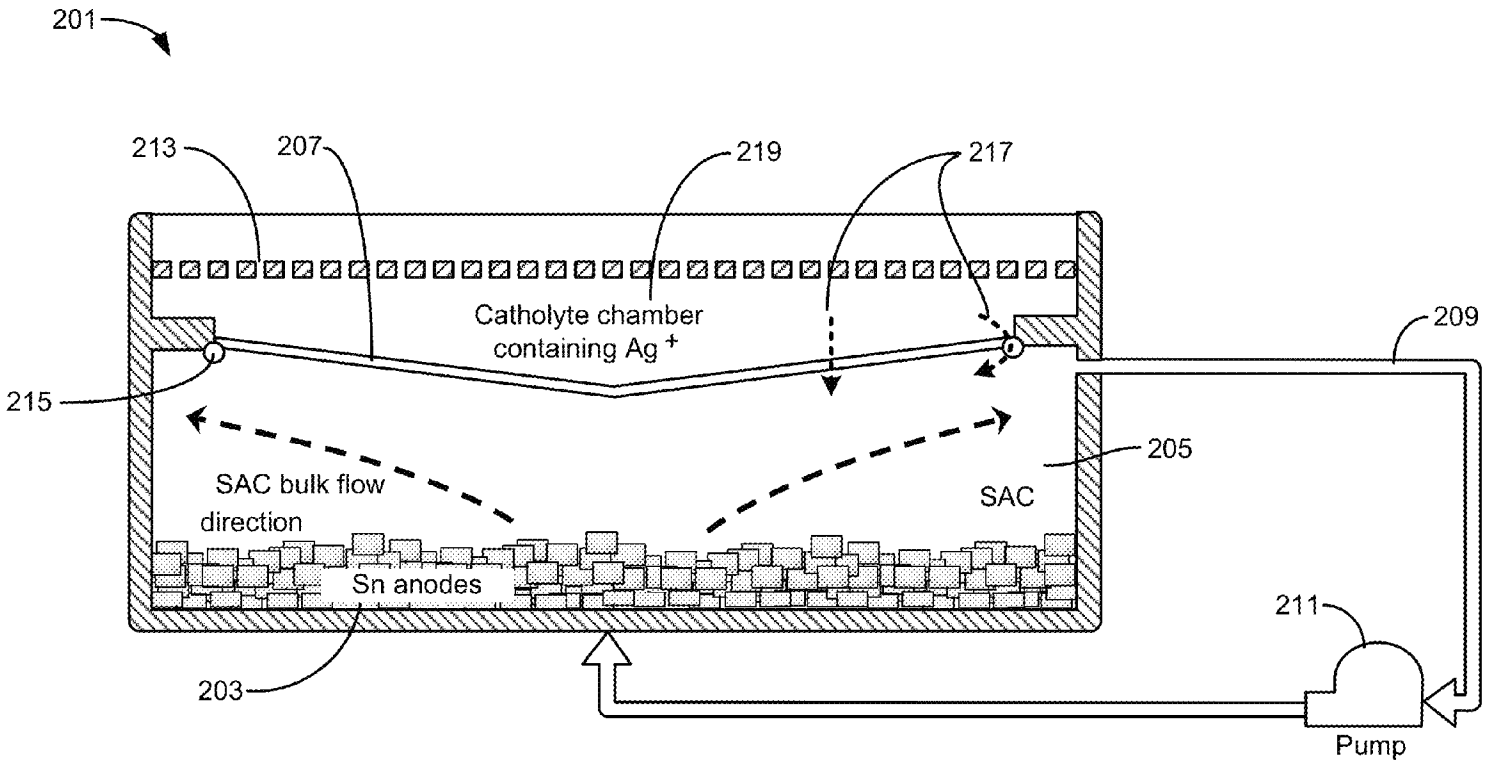
FIG. 2 is a cross-sectional schematic diagram of the electroplating cell for plating a tin silver alloy on a semiconductor substrate.

In certain disclosed designs employing SnAg active anode systems 201 as depicted in FIG. 2, certain embodiments overcome bulk gross exposure of the Sn anodes 203 to bath $Ag^+$ by providing a separate anode chamber (so called "SAC"). The anodes 203 are housed in the anode chamber 205, where the anolyte solution is composed of an electrolyte designed to be free of $Ag^+$. In conventional inert anode cells, MSA (Methane Sulfonic Acid) supporting electrolyte is used. The anolyte in such cells contains MSA and tin methane sulfonate, or in some embodiments, only the acid. A SAC separation structure interfaces with the rest the cell's catholyte via the cationic selective membrane 207, also known as cationic exchange membrane (CEM) sometime called a proton exchange membrane (PEM), an example of which is the commercially available Dupont product, Nafion®.

Although the membrane 207 can allow diffusion, osmosis and electro-osmosis or water transport, it prohibits motion of anions while selectively permitting transport of positive charged cationic species ($H_3O^+$, $M^+$, where M=Metal). The transport of metal cations across the membrane is generally substantially more restrictive compared to the transport of much smaller cations, particularly acid protons (H+ and $H_3O^+$). The cationic transport rate across the membrane depends on the mechanism or mode, namely (1) concentration gradient driven diffusion and (2) ionic mobility and current induced electro-migration. Migration occurs primarily during electroplating (though a diffusion or "junction potential" which can create an electric field under special circumstances), and is typically the overwhelmingly faster process for cationic species transport at that time, with positive ions moving in the direction from the anode in the SAC to the catholytic chamber and eventually to the wafer surface. However, during periods of no plating (idle), the remaining mode of specie transport becomes operative (diffusion). Diffusion of the highly mobile acid proton (typically 10× the mobility and diffusion coefficient of a metal ion) and less mobile metal cations across the membrane are somewhat impeded by the need to move through the membrane pores. The cationic membrane prohibits movement of free anions through it and within it. In contrast, the cationic membrane has anions which are bound or "tethered" as anchored sulphonate groups tied to the fluoropolymer backbone change (in the case of Nafion). To maintain charge neutrality inside the membrane matrix, the motion of cations is believed to occur by a series of atomic hops or jumps of the cationic in sequential formation and breaking of negative-positive pairs. This process generally hinders the diffusion process, since a higher activation energy for the transport process is required. Therefore, even a relative thin cation membrane can introduce a significantly transport resistance to cation diffusion and mixing across the catholyte to anolyte "barrier". Protons, with their small size and high mobility can move more rapidly, but because anions do not accompany the transport across the barrier and charge neutrality must be maintained (otherwise increasing the free energy due to charge separation, an unsustainable process), either another proton must move in the opposite direction, or a slower more kinetically hindered metal ion must transfer through the interface. In practice, the total ionic strength (total moles of cations+anions) of each of the two subsystem are largely immutable and would remain at that ionic strength save the diffusive motion of neutral species, particularly water (which is highly mobile across the water-swelled polymers). When the two chambers have differing total ionic strengths, water will, by diffusion and osmotic forces, move to dilute the chamber with the higher salt content (total ionic strength).

The above discussion assumes that there is no physical flow (convection) through the membrane itself. This is a reasonable assumption due to the very small (atomic-size) pores within the membranes and the very high viscous forces needed to cause bulk flow. Primarily only under extremely high pressures (100-1000's of psi and more) will significant flow of materials through the membrane occur, and even in that case, most of the transport will be of neutral water (reverse osmosis) because salts are still bound by electro-neutrality.

Because typical cationic membrane materials are not thermoplastics and are not plastic-weldable, O-ring and gasket seals 215 (often double, or sequential seals) are employed along the membrane sealing interfaces including the various SAC compartment sealing interfaces to ensure hermetic sealing and prevent gross leakage paths, thereby avoiding the possibility of bulk $Ag^+$ transporting from the catholyte into the SAC compartment. However, in practice, maintaining and setting up the SAC compartment to be hermetically sealed is not always guaranteed or practical. Damage from handling and imperfect machining surfaces can also lead to minute opening and gaps allowing flow or bypassing-diffusion leak paths 217 transporting $Ag^+$ from the catholyte chamber 219 around the membrane to the SAC compartment 205.

In certain embodiments, the cathode containing chamber is outfitted with channeled ionically resistive plate 213 that facilitates uniform plating over the face of the cathodic substrate. Plate 213 provides a relatively uniform current distribution over the plating face of the substrate and strong convection at the plating face. Plate 213 may contain through-holes that are spatially and ionically isolated from each other and do not form interconnecting channels within the body of plate. As an example, plate 213 is a disc made of an ionically resistive material, such as polyethylene, polypropylene, polyvinylidene difluoride (PVDF), polytetrafluoroethylene, polysulphone, polyvinyl chloride (PVC), polycarbonate, and the like, having between about 6,000-12,000 non-communicating through-holes. The plate, in many embodiments, is substantially coextensive with the wafer substrate (e.g., has a diameter of about 450 mm when used with a 450 mm wafer) and resides in close proximity of the wafer, e.g., just below the wafer in a wafer-facing-down electroplating apparatus. In certain embodiments, the plated surface of the wafer resides within about 10 mm, or within about 5 mm of the closest plate surface. Channeled ionically resistive plates and there applications are presented in U.S. patent application Ser. No. 13/893,242, filed May 13, 2013, and titled "CROSS FLOW MANIFOLD FOR ELECTROPLATING APPARATUS", which is incorporated herein by reference in its entirety.

In one embodiment, the pressure in the separated anode chamber is always slightly higher than the pressure above the membrane. This is accomplished, for example, by having a pneumatic anode chamber fluid flowing-outlet pressure regulating device (sometime referred to as the SAC "fountain") that is vented to atmosphere at a level above the top surface of the fluid in the catholyte chamber, thereby maintaining a static pressure on the membrane at all times and, in the event of a small leak, having fluid flow from the SAC compartment to the catholyte chamber. This configuration makes the bulk flow of fluid through the leak path be in the direction opposite that of any diffusion into the SAC. Refer to U.S. patent application Ser. No. 13/051,822 titled "ELECTROLYTE LOOP FOR PRESSURE REGULATION FOR SEPARATED ANODE CHAMBER OF ELECTROPLATING SYSTEM" filed on Mar. 18, 2011 (and incorporated herein by reference in its entirety) for more details about this embodiment.

Despite on-going effort in design and process, and even with a perfect seal or having a slow flow forced backwards though a small leaking seals, diffusion of some $Ag^+$ across the membrane, albeit however slow, may still occur. Over time, there is a risk for the SAC compartment will become contaminated with unwanted $Ag^+$ leading to continuous reaction of silver with the less noble pure tin anode. The associated spontaneous displacement reaction may in some way coat the tin anode with a film of silver of $Ag_3Sn$, and such a film my slowly lead to inhibition of the dissolution of tin metal, otherwise colloquially referred to as "anode passivation". Therefore, this remains an open issue and a potential risk factor for one using an active anode.

In the event of $Ag^+$ 'leaking' into the SAC compartment, it can be reasoned that passivation of the anode may occur non-uniformly over the surface, or, in the case of a porous anode composed of a pile of anode spheres or slugs, non-uniformly in the depth of the anode. Generally, the upper surface of any anode is ohmically preferred to undergo reaction, and any lower surfaces or "shadowed" sphere not yet exposed for use, are largely electrochemically inactive until the metal anode closer to the cathode has been corroded and utilized. Therefore, for a porous anode, exposure of the surfaces to silver "contamination" may occur over a period of weeks or even months before that portion of the anode is actually used, at which time, the amount of displaced silver may be non-uniformly deposited on the tin interface. This non-uniform film coverage can lead to selective passivation, because, on application of current, initial the silver and $Ag_3Sn$ film we be removed uniformly, but require a higher potential than that of pure tin. Once one location (e.g. the centrally located region of the anode) has completely corroded of the silver rich film, the potential for dissolution there drops. Because the anode as a whole is electrically tied and can exert only a single potential, the potential of the anode as a whole will drop, the silver free portion of the anode will carry a disproportionately greater current density, and the uniformity of the plated film on the wafer will suffer. As a result, on wafer performance and the cell's behavior will begin to drift out of specifications once the anode becomes un-uniformly and/or sufficiently passivated. Without silver displacement reaction mitigation and/or detection in place, the robustness of a plating process cannot be assured, and may vary from wafer to wafer and over time significantly, leading to reduced repeatability and low predictability from tool-to-tool and setup-to-setup, as long as the inherent risk of anode passivation remains.

A discussion of suitable apparatus, anolyte and catholyte compositions, and continuous plating methods is found in U.S. patent application Ser. No. 13/305,384 (published as US20120138471A1), previously incorporated herein by reference in its entirety.

As explained, a plating cell may contain a cathode chamber 219 configured for holding catholyte and a substrate (which is cathodically biased during plating) and an anode chamber configured for holding anolyte and the anode, where the anode chamber 205 and the cathode chamber 219 are separated by a separation structure, and where the anolyte contained in the anode chamber is substantially free of metal ions of the nobler metal. In some embodiments the anolyte is also substantially free of plating bath additives such as grain refiners, brighteners, levelers, suppressors, and noble metal complexing agents. The anolyte is electrolyte that contacts the anode and has a composition appropriate for contacting the anode and allowing it to create a soluble anode metal species upon electrochemical dissolution of the anode. In the case of tin, the suitable anolyte may be highly acidic (preferably with pH of less than 2) and/or contain a tin complexing agent (e.g. a chelator such as an oxalate anion). Conversely, the catholyte is electrolyte that contacts the cathode and has a composition appropriate for that role. For tin/silver plating, one exemplary catholyte contains acid (e.g., methanesulfonic acid), a salt of tin (e.g., tin methanesulfonate), silver complexed with a silver complexer (e.g., silver complex with a thiol-containing complexer such as 3,6-dithiaoctane-1,8-diol), and a grain refiner (e.g. polyethyleneglycol (PEG), hydroxylated cellulose, gelatin, peptone, etc.). The separator helps maintain the distinct compositions of the anolyte and the catholyte within the electroplating chamber, even during electroplating, by selectively excluding certain electrolyte components from passage through the separator. For example, the separator can prevent the ions of a nobler metal from flowing from catholyte to anolyte. The term "flow" as used herein encompasses all types of ion movement.

The following principles can be employed in designing an electroplating apparatus and/or process suitable for plating a composition containing a more noble element and a less noble element: (1) the less noble element is provided in the anode chamber, (2) a soluble compound of the more noble element (e.g., a salt of that element, often in a complexed form) is blocked from transport from the cathode chamber to the anode chamber, e.g., by the separator and (3) the soluble compound of the more noble element is applied to the cathode chamber only (not to the anode chamber). In certain embodiments, the less noble element is provided at least via a consumable anode containing that element (and can be also provided in solution in addition to consumable anode), which is electrochemically dissolved during plating.

An example of a suitable apparatus for plating in accordance with embodiments provided herein is schematically illustrated in FIG. 1A below. Generally the apparatus exemplified herein represent various types of "fountain" plating apparatus, but the invention itself is not so limited. In such apparatus, the work piece to be plated (typically a semiconductor wafer in the examples presented herein) has a substantially horizontal orientation (which may in some cases vary by a few degrees from true horizontal) and rotates during plating with generally vertically upward electrolyte convection. One example of a fountain plating apparatus is the Sabre® Electroplating System produced by and available from Novellus Systems, Inc. of San Jose, Calif. Additionally, fountain electroplating systems are described in, e.g., U.S. Pat. No. 6,800,187 and US Patent Application Publication US 2010-0032310A1 published Feb. 11, 2010, which are incorporated herein by reference in their entireties. It should be understood that some aspects of the invention may apply to other types of electroplating apparatus such as paddle plating apparatus including those developed and/or commercialized by IBM, Ebara Technologies, Inc., and Nexx Systems, Inc. Paddle plating apparatus generally hold the work piece in a vertical orientation during plating and may induce electrolyte convection by periodic movement of a "paddle" in the cell. Hybrid configuration may also be employed, which may be configured for rotating the wafer horizontally in a face down orientation with an agitator near the wafer's surface. In some embodiments an apparatus contains components, configured to improve electrolyte flow distribution in the proximity of the wafer substrate, such as those provided in the U.S. application Ser. No. 13/172,642 filed on Jun. 29, 2011 naming Mayer et al. as inventors and titled "Control of Electrolyte Hydrodynamics for Efficient Mass Transfer during Electroplating", which is incorporated herein by reference in its entirety.

Figure 1B:
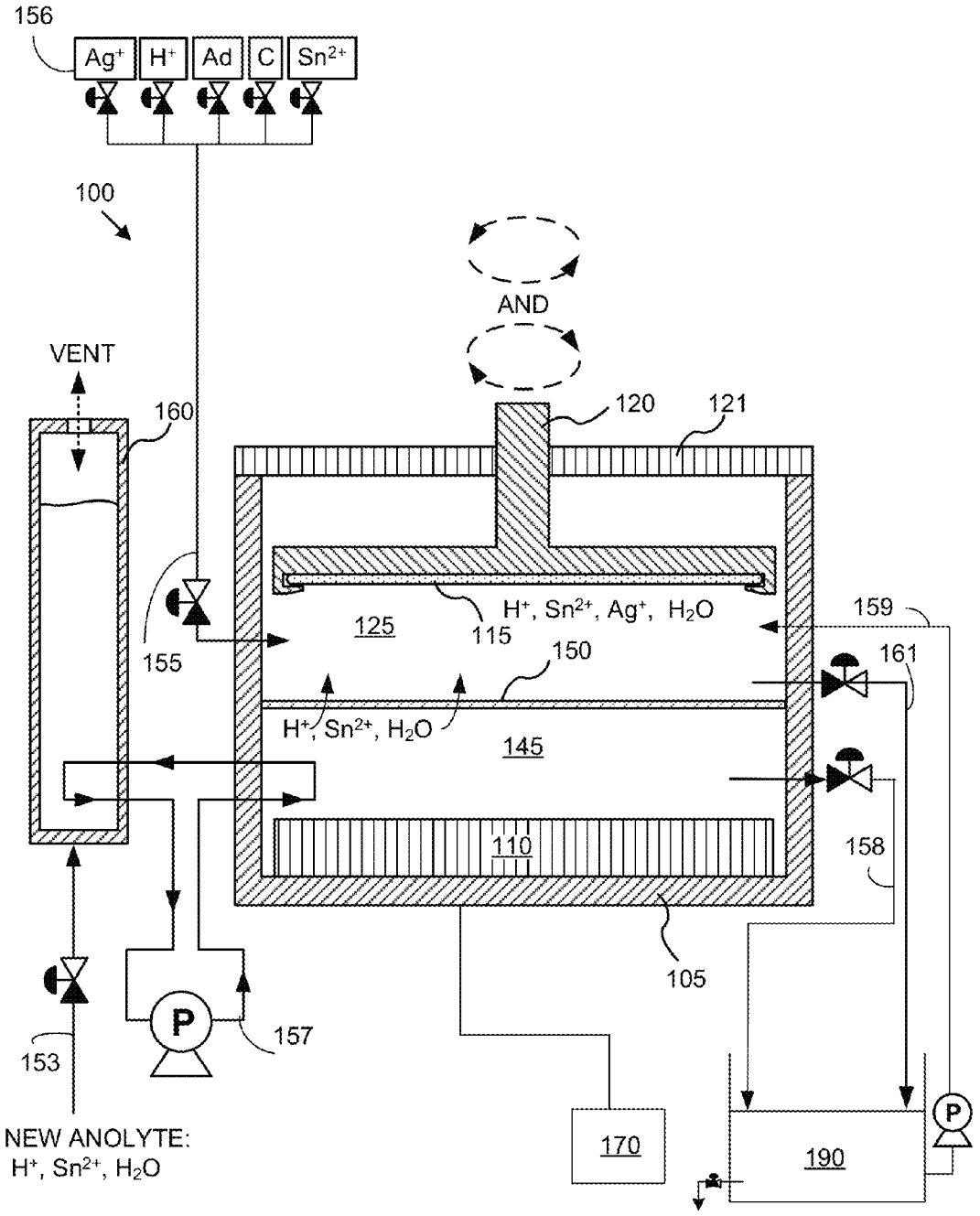
FIG. 1B is a diagrammatic cross-sectional view of another embodiment of an electroplating apparatus in accordance with the present disclosure.

FIGS. 1A and 1B show schematic cross sections of a suitable electroplating apparatus 100, containing plating cell 105, in accordance with two embodiments of the invention. The difference between the apparatuses depicted in FIGS. 1A and B is the presence of a reservoir 190 in the apparatus depicted in FIG. 1B, and in the associated arrangement of fluidic features. The illustrated apparatus is configured for plating silver and tin, but can be also used to plate other combinations of metals with different electrodeposition potentials. In the discussion of apparatuses below, tin, can be replaced with a "first metal" (less noble metal), and silver can be replaced with a "second metal" (more noble metal).

In the apparatus 100, an anode 110, which is a consumable tin anode, is typically located in a lower region of the plating cell 105. A semiconductor wafer (or other work piece) 115 is positioned in catholyte retained in the catholyte chamber 125 and is rotated during plating by a wafer holder 120. Rotation can be bidirectional. In the depicted embodiment the plating cell 105 has a lid 121 over the cathode chamber. The semiconductor wafer is electrically connected to a power supply (not shown) and is negatively biased during electroplating, such that it serves as a cathode. The active tin anode is connected to the positive terminal of the power supply. A separator 150 which is at a minimum cationically conductive for protons and inhibits direct fluid flow transfer between the anolyte and catholyte chambers, is located between the anode and the wafer (the cathode) as it separates and defines an anode chamber 145 and a cathode chamber 125. As explained, the isolated anodic region of the plating cell is often referred to as a Separated Anode Chamber (SAC). An electroplating apparatus having a SAC is described in detail in U.S. Pat. No. 6,527,920 issued on Mar. 4, 2003 to Mayer et al., U.S. Pat. No. 6,890,416 issued on May 10, 2005 to Mayer et. al., and U.S. Pat. No. 6,821,407 issued Nov. 23, 2004 to Reid et al., which are herein incorporated by reference in their entireties.

Separator 150 allows selective cationic communication between the separated anode chamber and the cathode chamber, while preventing any particles generated at the anode from entering the proximity of the wafer and contaminating it. The separator, as mentioned, allows flow of protons, from anolyte to catholyte during plating. Further, the separator may allow passage of water from anolyte to catholyte, which moves along with the protons. In some embodiments, the separator is also permeable to tin ions during plating, where the tin ions will move from anolyte to catholyte, when potential difference is applied (but not in the absence of potential difference). The separator may also be useful in prohibiting anionic and non-ionic species such as bath additives from passing though the separator and being degraded at the anode surface, and as such, in some embodiments, the anolyte contained in the anode chamber remains substantially free of organic additive species (such as accelerators, levelers, suppressors, grain refiners, and silver complexers) present in the catholyte that are used to control within wafer, within die or within feature uniformity or various metrological properties.

The separator having these properties can include an ionomer, e.g., a cationic polyfluorinated polymer having sulphonate groups, such as the commercially available product made by DuPont de Nemours provided under the trade name Nafion or VaNaDION from Ion Power of New Castle Del. The ionomer can be mechanically reinforced, e.g., by incorporation of reinforcing fibers within the ionomer membrane, or externally by a mechanical construct, and can reside on a mechanically strong support such as a solid material with drilled holes to create a reticulated structure, or a continuously sintered microporous material, e.g., a microporous sheet material such as Porex™.

In the embodiment depicted in FIG. 1B, catholyte is circulated from a plating reservoir 190 to the cathode chamber 125 using a pump and is returned to the reservoir by gravity draining Generally, the volume of the reservoir is greater than the volume of the cathode chamber. Between the reservoir and the catholyte chamber the circulating catholyte can undergo a number of treatments, including filtration with the use of filters (e.g., configured to remove particles) and/or fluid contactors configured for removal of dissolved oxygen in circulating catholyte. Catholyte is periodically removed from the bath/catholyte via a drain line or overflow line in the reservoir. In some embodiments one reservoir services several cells and may be fluidically connected to cathode chambers of more than one cell (not shown). In the embodiment shown in FIG. 1A an apparatus which does not have a catholyte reservoir is shown.

The apparatus (in both embodiments shown in FIGS. 1A and B) contains an anolyte circulation loop 157, which is configured to circulate anolyte within and to and from the anode chamber. The anolyte circulation loop typically includes a pump configured to move the anolyte in the desired direction, and may optionally contain a filter for removing particles from circulating anolyte, and one or more reservoirs for storing anolyte, and a getter. In the depicted embodiment the anolyte circulation loop includes a pressure regulator 160. The pressure regulator comprises a vertical column arranged to serve as a conduit through which the anolyte flows upward before spilling over a top of the vertical column, and wherein, in operation, the net height difference between the fluid level in the catholyte chamber 125 and the highest point of the fluid in the pressure regulator creates a vertical column that provides a positive pressure head above atmospheric pressure on the separator membrane 150 and maintains a substantially constant pressure in the anode chamber. In the depicted embodiment the anolyte is configured to flow from the anode chamber to the pressure regulator before returning to the anode chamber. The pressure regulator in some embodiments has a central tube with a top surface through which fluid enters the pressure regulator containment vessel, and then spills over as a fountain into the pressure regulator reservoir region below. This allows the height of the central tube relative to the catholyte fluid height to define and maintain the net positive pressure in the chamber at all times, independent of the exact amount of fluid actually contained in the combined anode chamber and pressure regulator system. The pressure regulator 160 is described in more detail below.

The apparatus further contains fluidic features configured to add acid and stannous ion to the anolyte. Addition of acid and stannous ion can be accomplished at any desired point—directly to the anode chamber, to the lines of the anolyte circulation loop, or to the pressure regulator, as depicted in FIG. 1A, which shows line 153 delivering the fresh anolyte solution which comprises acid, stannous ion, and water. The apparatus may also include a source or several sources containing acid and stannous ion solution outside the anode chamber, and fluidically connected to the anode chamber. The acid and stannous ion solutions can be delivered in separate streams, or can be pre-mixed before delivery to the anolyte. Further, in some embodiments, a separate line for delivering water (without acid or stannous ion) to anolyte can fluidically connect a water source to the anolyte.

The apparatus further includes a fluidic conduit 159, configured for delivering anolyte containing acid and stannous ion from the anode chamber to the cathode chamber or to the reservoir 190 containing surplus catholyte (in the embodiment of FIG. 1B). In some cases there is a pump associated with this conduit and configured to pump anolyte to the catholyte chamber. In other cases, the transfer is made to a reservoir that is located at a lower level than the cell and fluid simply flows downhill by gravity into the reservoir 190 as illustrated by 158. In other embodiments 158 can be a fluid line or any other fluidic conduit configured to deliver anolyte to the reservoir 190. From the reservoir 190 the fluid can be directed to the cathode chamber via a conduit 159. This anolyte to catholyte "cascade" stream (with or without the use of reservoir) is significant for replenishing the catholyte with the stannous ion, for removing fluid from the anolyte system and thereby for making room for fresh, acid-rich replenishment chemistry in the anode chamber. In some embodiments, the cascade stream transference occurs passively via an overflow conduit in the pressure regulator chamber. When a volume of introduced feed high-acid low-tin material is introduced to the anolyte system, the low-acid/high-tin electrolyte in the anode chamber overflows into the conduit and into the plating reservoir 190, because the total volume in the anolyte system, and therefore level in the pressure regulator, exceeds the level of the overflow conduit inlet in the pressure regulator. In some embodiments, at least some stannous ion moves to the cathode chamber both through the separator during plating and via the cascade fluidic conduit.

The cathode chamber of the apparatus, depicted in the embodiments shown in FIGS. 1A and B, includes an inlet configured for receiving a solution containing silver ions, and an associated fluidic conduit 155 connecting a source of silver ions to the cathode chamber. In some embodiments, e.g., as shown in FIG. 1B, the catholyte addition system 155 includes an inlet distribution manifold 156 allowing for each of the chemical in the bath to be added to the catholyte. Typically silver, silver complexer, and organic additive are added to the catholyte/bath in an amount necessary to maintain their concentration at a desired target, and includes quantities of electrolyte components required to replace chemistry removed by the bleed operation and to make up for dilution by incoming silver-free and additive-free (in some embodiments) cascade flow, as well as any dosing associated with charge based consumption or degradation. While in some embodiments one does not need to dose acid or tin into the catholyte, enabling one to do so may allow for better operational control. Additions to the catholyte of the components may be controlled based on deviation from target concentrations derived from metrology based feedback data, and the quantities of tin and acid required for these corrections are relatively small (i.e., they are minor corrections and are materially and volumetrically small with respect to the major source by which these materials are added to the system, the anolyte feed and the anode). Thus, in some embodiments (regardless of the presence of the reservoir), the apparatus further includes fluidic features configured for adding a number of plating additives (such as grain refiners, accelerators and levelers) and/or complexing agent to the catholyte from a combined single source or from separate sources. In some embodiments the silver and a complexer are added from a single source (i.e., complexed silver ion is added). Importantly, in the depicted embodiment of FIG. 1A, it is not necessary to separately dose stannous ion to the catholyte, as this function is performed by the cascade (anolyte-to-catholyte) stream, and, to some degree, by the separator which may allow for some stannous ion transport. But in alternative embodiments, a separate source of stannous ion and an associated fluidic conduit may be connected to the cathode chamber and may be configured to add stannous ion solution for optimally tight process control of the tin catholyte concentration. Further, in the depicted embodiment, it is not necessary to add acid solution to the catholyte (as this is accomplished through the separator and by the cascade stream). In other embodiments, a source of acid and an associated fluidic conduit may be connected to the cathode chamber and may be configured to add acid solution to the catholyte for optimally tight process control of the acid catholyte concentration.

Further, the apparatus includes an outlet in the cathode chamber and associated fluidic features 161, configured to remove a portion of the catholyte from the cathode chamber. This stream is referred to as a "bleed" stream and typically contains silver ions, tin ions, acid, complexer and additives (such as grain refiners, brighteners, suppressors, accelerator and leveler). This stream is significant for maintaining overall mass and volume balance of the plating cell. In the embodiment depicted in FIG. 1A, the catholyte bleed 161 is discarded or is directed for regeneration of metals. In the embodiment depicted in FIG. 1B, the catholyte from the cathode chamber is directed to the reservoir 190 via a conduit 161. The reservoir 190 is configured to drain some of electrolyte contained in the reservoir. Importantly, in the depicted embodiment the apparatus does not need to be configured to bleed anolyte (though the anolyte is cascaded to the catholyte), and catholyte bleed is sufficient for maintaining balance. In alternative embodiments, the apparatus may include a port and associated fluidic features configured for removing (bleeding) the anolyte from the apparatus (e.g., from the anode chamber or from the anolyte recirculation loop).

Fluidic features, referred to herein, may include but are not limited to fluid conduits (including lines and weirs), fluid inlets, fluid outlets, valves, level sensors and flow meters. As can be appreciated, any of the valves may include manual valves, air controlled valves, needle valves, electronically controlled valves, bleed valves and/or any other suitable type of valve.

A controller 170 is coupled to the apparatus and is configured to control all aspects of plating including parameters of feeding anolyte and catholyte, bleeding the catholyte, delivering anolyte to catholyte, etc. Specifically the controller is configured to monitor and control parameters (e.g. current, charge passed, bath levels, flow rates, and timing of dosing) related to need for addition of acid to anolyte, stannous ions to anolyte, water to anolyte, silver ions to catholyte, additive to the catholyte, complexer to the catholyte, delivery of anolyte to catholyte, and of bleeding (removal) of catholyte.

The controller can be configured for coulometric control of the plating process. For example, bleed-and-feed and cascading can be controlled, based on the amount of Coulombs passed through the system. In specific examples, dosing of acid, and stannous ion to anolyte, dosing of silver to catholyte, cascading of anolyte to catholyte, and bleed from the catholyte can be initiated after a pre-determined number of Coulombs passed through the system. In some embodiments, these are controlled, in response to predetermined time that has elapsed, or in response to the number of substrates processed. In some embodiments, dosing of water to compensate for evaporation is made periodically (feed forward time based) and/or in a feedback mode based on changes in measured bath volume.

In some embodiments, the controller is also configured to adjust parameters of the system (such as flow rates in the mentioned streams, and timing of dosing) in response to feedback signals received from the system. For example, concentrations of plating bath components can be monitored in anolyte and/or catholyte using a variety of sensors and titrations (e.g., pH sensors, voltammetry, acid or chemical titrations, spectrophotometric sensors, conductivity sensors, density sensors, etc.). In some embodiments the concentrations of electrolyte components are determined externally using a separate monitoring system, which reports them to the controller. In other embodiments raw information collected from the system is communicated to the controller which conducts concentration determinations from the raw data. In both cases the controller is configured to adjust dosing parameters in response to these signals and/or concentrations such as to maintain homeostasis in the system.

Further, in some embodiments, volume sensors, fluid level sensors, and pressure sensors may be employed to provide feedback to the controller.

As mentioned, in some embodiments the anode chamber is coupled to a pressure regulator (e.g., pressure regulator 160), which is capable of equalizing the pressure in the anode chamber with atmospheric pressure. Such pressure-regulating mechanism is described in detail in U.S. application Ser. No. 13/051,822 titled "ELECTROLYTE LOOP FOR PRESSURE REGULATION FOR SEPARATED ANODE CHAMBER OF ELECTROPLATING SYSTEM" filed on Mar. 18, 2011 and naming Rash et al. as inventors, which is incorporated herein by reference in its entirety.

The apparatus and processes described hereinabove may be used in conjunction with lithographic patterning tools or processes, for example, for the fabrication or manufacture of semiconductor devices. Typically, though not necessarily, such tools/processes will be used or conducted together in a common fabrication facility. Lithographic patterning of a film typically comprises some or all of the following steps, each step enabled with a number of possible tools: (1) application of photoresist on a workpiece, i.e., substrate, using a spin-on or spray-on tool; (2) curing of photoresist using a hot plate or furnace or UV curing tool; (3) exposing the photoresist to visible or UV or x-ray light through a mask using a tool such as a wafer stepper; (4) developing the resist so as to selectively remove resist and thereby pattern it using a tool such as a wet bench; (5) transferring the resist pattern into an underlying film or workpiece by using a dry or plasma-assisted etching tool; and (6) removing the resist using a tool such as an RF or microwave plasma resist stripper. This process may provide a pattern of features such as Damascene, TSV, RDL, or WLP features that may be electrofilled with silver tin using the above-described apparatus. In some embodiments, electroplating occurs after the resist has been patterned but before the resist is removed (through resist plating).

As indicated above, various embodiments include a system controller having instructions for controlling process operations in accordance with the present invention. For example, a pump control may be directed by an algorithm making use of signals from the level sensor(s) in the pressure regulating device. For example, if a signal from a sensor indicates that fluid is not present at the associated level, the controller may direct that additional make up solution or DI water be provided into the anolyte recirculation loop to ensure that there is sufficient fluid in the line that the pump will not operate dry (a condition which could damage the pump). Similarly, if the upper level sensor signals that fluid is present in the associated level, the controller may direct may take steps to reduce the amount of recirculating anolyte, as explained above, thereby ensuring that the filtered fluid in the pressure regulating device remains between the upper and lower levels of the sensors. Optionally, a controller may determine whether anolyte is flowing in the open recirculation loop using, for example, a pressure transducer or a flow meter in the line. The same or a different controller will control delivery of current to the substrate during electroplating. The same or a different controller will control dosing of make up solution and/or deionized water and/or additives to the catholyte and anolyte.

The system controller will typically include one or more memory devices and one or more processors configured to execute the instructions so that the apparatus will perform a method in accordance with the present invention. Machine-readable media containing instructions for controlling process operations in accordance with the present invention may be coupled to the system controller.

Gettering Embodiments

The disclosed embodiments concern hardware and processes suited for extracting a relatively dilute, more noble metal "contaminant" (e.g. silver), from an anode chamber containing a less noble metal anode (for example pure low alpha tin), which is termed "gettering hardware and processes". In a particular embodiment, the getter removes unwanted $Ag^+$ that finds its way into the SAC compartment and would otherwise react with the active Sn metal anode, eventually leading to various forms of incapacitation, including but not limited to: higher anode interfacial and cell plating voltages, particle formation, local or global anode passivation with use (charge) and over time. With the gettering processes and hardware, the anode is at least partially protected from passivation, and the risk from the various failure mechanisms outlined earlier is mitigated.

Passivation affecting performance generally occurs after a considerable amount of $Ag^+$ reacts on the tin anodes. Two different general classes of hardware and methods are disclosed herein: (1) a "passive gettering approach" and (2) an "active gettering approach". The passive approach basically differs from the active approach with respect to method of noble metal removal from the anolyte. The passive approach relies on the removing noble metal ions from anolyte via a chemical removal (for example a metal-metal displacement reaction or a selective ion-exchange process). The active approach involves removal of the noble metal based on its more positive reduction potential and therefore by using primarily an electrochemically driven process.

Regardless of whether passive or active gettering is employed, additional features may be provided in the separated anode chamber to promote uniform flow to, around and/or throughout (if porous) the cell anode or getter. In the case where there is slow transference between chambers, which may occur over long periods of time (e.g., several weeks), or due to a sudden inadvertent anode-to-catholyte electrolyte separation breach or backflow, uniform electrolyte flow to, around over or through the anode is usually desirable. Deposition of dissolved silver ion will occur at a greater propensity on portion of the anode where the supply of silver ion is greatest. This may be the portion where convective flow is greatest. Those higher flow portions of the anode will subsequently become progressively more extensively coated with a silver coating than other portions. As a result, those high-silver-film-covered portions of the anode will also be more resistive to tin dissolution. As a specific example, consider a peripheral (versus central) portion of the anode is exposed to a higher electrolyte flow. That region will have its tin surface more extensively coated with an un-reactive and dissolution-blocking silver film. Conversely, the center regions of the anode will have relatively less silver coating, and have a smaller amount of the local surface blocked by the silver film. Further, if the anode is a porous anode, the lowest section of the anode is largely un-reactive to the electrolytic dissolution process until layers of materials (e.g., particles, nuggets, or spheres) are electro-anodized first. Therefore, these lower anode portions continue to accumulate any silver ions from the anolyte, integrated over a long period of time (several weeks to even several months).

When the particular layer of tin active anode is finally exposed due to the reaction/dissolution of upper layers above them, and when they are then called upon to deliver tin and current to plate a wafer, more current will tend to emanate (originate) from the region where there is less silver surface coating. In this example, the central region, having a relatively lower flow, will have accumulated less silver coating (e.g. 50%), vs. the edge (e.g. 80%). Unfortunately, to provide radially uniform deposition on the work piece, the average local anode current density should be uniform with radius. However, the microscopic effective local current density (measured as the average local current density divided by the fraction of non-silver coated portion of the electrode) must be significantly greater in the high-silver-coverage portion of the anode in order to maintain the required radial uniform average local anode current density. Because the anode metal phase is generally held at nearly the same potential throughout, and regions of higher silver coverage have higher anodic dissolution kinetic resistance, those regions will have a lower average local anode current density. That local average local anode current density can lead to a non-favorable shift in the globally non-uniform current distribution on the wafer (make it progressively more non-uniform as the % difference in radial silver content increases with anode depth during use). To avoid such a situation, having the fraction of non-silver coated portion radially uniform by supplying uniform flow to, around and through the anode, enables one to maintain radially uniform within wafer uniformity (WIW).

Figure 9:
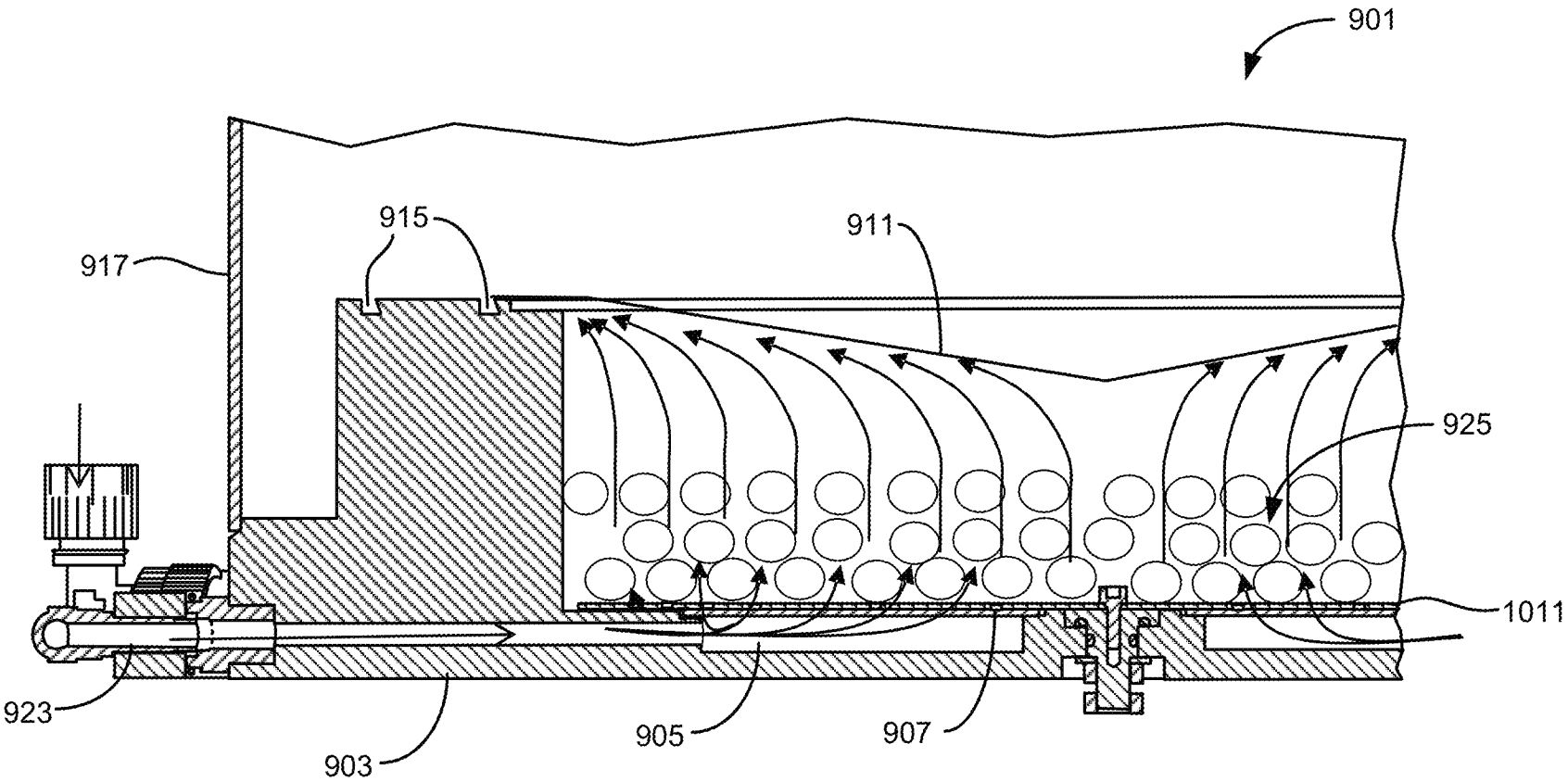
FIG. 9 is a cross-sectional depiction of a separated anode chamber containing a porous anode with an underlying inlet manifold.
Figure 10:
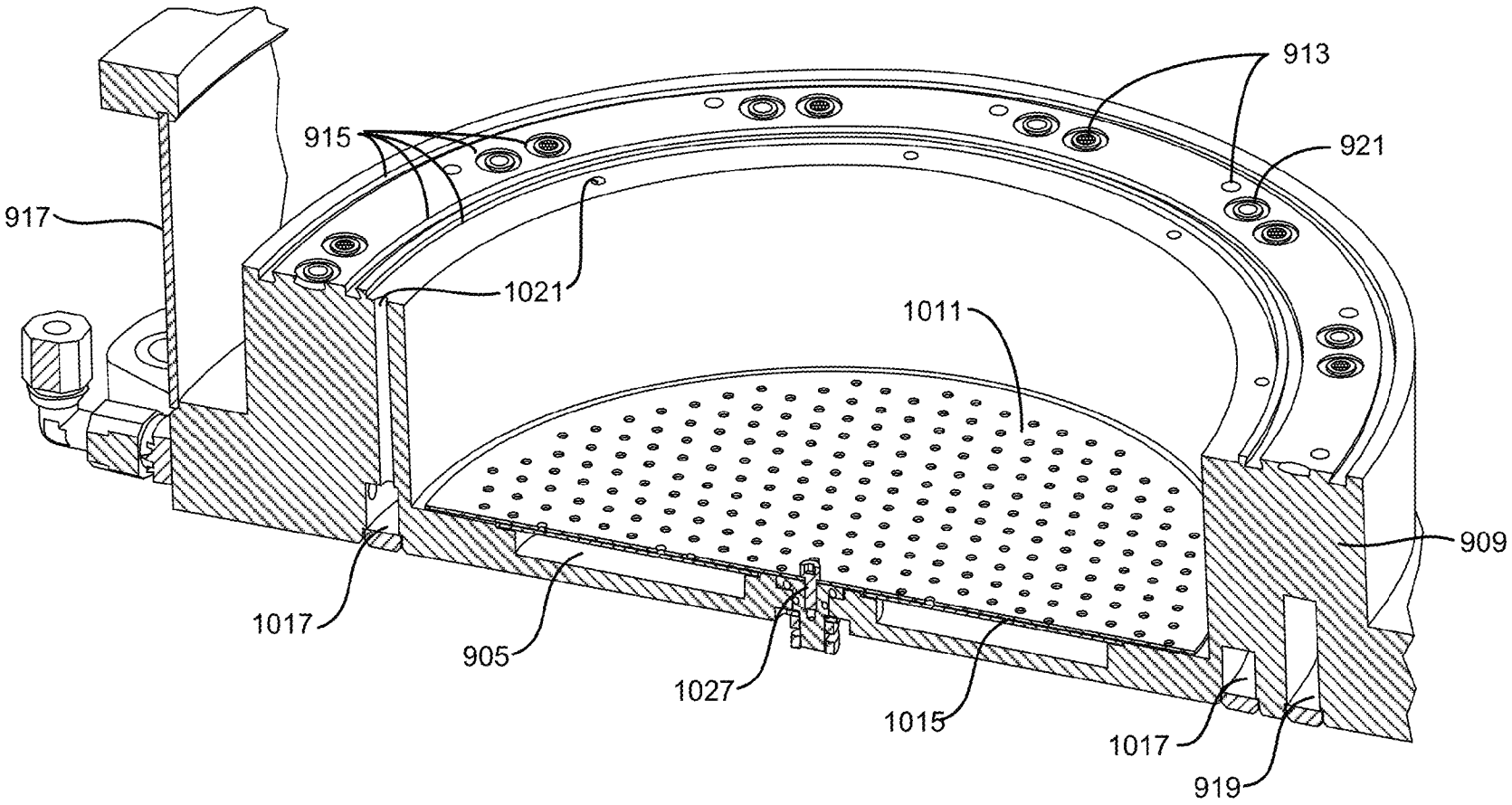
FIG. 10 is an isometric view of the separated anode chamber of FIG. 9 but providing a view of a porous anode current distribution plate.

A manifold for delivering anolyte to the anode may provide substantially uniform distribution over the anode surface in the radial and azimuthal directions. FIGS. 9 and 10 depict one example of a suitable anolyte delivery manifold 905.

As shown in FIGS. 9 and 10, an electroplating cell 901 includes a separated anode chamber 903 bounded by, inter alia, an anode chamber wall 909 around the edge perimeter, an ion selective membrane and associated frame 911 on the top, and a current distribution plate 1011. The anode chamber wall 909 may include various fixing elements such as screw holes 913 for mounting a catholyte chamber and o-ring recesses 915 for sealing the membrane and frame 911 to the anode chamber wall 909. The catholyte chamber is bounded by a catholyte containment wall 917 disposed outside anode chamber wall 909. The anode chamber wall 909 includes a catholyte injection manifold 919 and catholyte injection lines 921 for delivering catholyte to the catholyte chamber. Anolyte is provided to the anode chamber 903 via a flow inlet line 923 and then through an inlet manifold 905 spaced under all or most of the porous tin anode(s) 925. The anolyte leaves the manifold 905 via a porous flow distribution element 1015 to contact anode(s) 925. Anolyte exits the anode chamber 903 via anolyte flow return lines 1021 in the anode chamber wall 909. Current is provided to the anodes via a pass-through electrical connection 1027 connected to current distribution plate 1011, which has numerous holes for delivering anolyte to the anode(s).

Passive Gettering

In passive gettering, a suitable material is used to remove or reduce unwanted contamination by reactive noble ions (e.g., $Ag^+$ ions). In certain embodiments, passive gettering is used to remove traces of such noble ions from a SAC compartment. As mentioned, a passive gettering approach relies on a chemical mechanism and therefore need not integrate the gettering material in an electrode of an electrochemical cell. Typically, a passive gettering material is placed in the path of anolyte flowing, at least partially, toward the anode in the SAC compartment. Certain suitable locations for the gettering material are presented in the embodiments discussed below. See for example the embodiments depicted in FIGS. 3-5 as well as in FIGS. 11 and 12. Typically, the getter material is present in a quantity sufficient to remove the amount of noble metal ions conservatively expected to enter the SAC over an extended time period, e.g., at least about a day or at least about two days or at least about a week, more commonly several weeks. Of course, these periods can vary depending on the throughput of the system and other factors. Typically, the getter material has a surface area sufficient to react with and remove a large fraction of the noble metal ions in the anolyte flowing through it. For example, the getter may be designed to remove at least about 90% of noble ions flowing through it, or at least about 95% of such ions, or at least about 99% of such ions, or at least about 99.9% of such ions. The gettering material may include a metal that oxidizes to produce a metal ion at a potential that is lower (less noble, e.g., tin) than that of the metal being removed from the anolyte (e.g., silver). Additionally, the reduction potential of the gettering metal may be the same as or less negative than that of the plating anode material (e.g., tin).

In various embodiments, the gettering material is solid and does not at any time introduce foreign or incompatible specie(s) into the anolyte which would interfere with the plating reaction. For example, a metal, M, that is much less noble than silver, is capable of gettering $Ag^+$ by the following general reaction: $M(s)+nAg^+ \rightarrow nAg(s)+M^{n+}$. However, this metal ion, $M^{n+}$, is introduced in the electrolyte. Hence, one suitable gettering material for SnAg system is solid (low alpha) tin, which produces low alpha $Sn^{2+}$ ions as the byproduct of the gettering process, a component of the electrolyte. So, in this example, the metal of the passive getter is the same as the active anode itself.

In another example of a passive-type metal displacement type gettering process, the gettering material is a metal different than that of the active anode. One may employ a getter metal whose reduction potential is sufficiently more negative (less noble) than either of the metals of the alloy to be plated. As a particular example, a suitable metal for plating tin-silver solders should be less noble and have a standard reduction potential more negative than both silver (E=+0.799V vs. NHE) and tin (E=−0.123 vs. NHE). The material also should not corrode aggressively in the anolyte (e.g. if using an acidic electrolyte, the material should not spontaneously and rapidly dissolve via a coupled corrosion reactions of the electrolyte to form hydrogen). Depending on particularly solutions pH, anion, and other factors, exemplary non-tin suitable SnAg getter materials include nickel (E=−0.23V vs. NHE), cobalt (E=−0.28V vs. NHE), and indium (E=−0.338V vs. NHE).

In a third example of a passive-type gettering process, the gettering material is an insoluble inorganic compound (of the anode metal material in some cases, e.g. Sn when plating SnAg) which is (1) substantially insoluble in the anolyte, (2) will react with silver ions, and (3) forms an insoluble inorganic silver compound. As a particular example of this type of getter material, tin (II) sulfide, whose solubility is estimated to be 0.000002 g/L may react to form silver (I) sulfide, having a solubility estimated to be $9\times10^{-14}$ g/L.

In yet another example of a passive-type gettering process, the gettering material is an ion-selective ion-exchange-resin, selective for removal of the more noble metal ion. Ion-exchange resins containing mercapto-, sulfide and thiol terminated end groups bound to a polymeric matrix background would be suitable.

In certain embodiments where the passive metal getter material is the same species as the anode (e.g. a low alpha tin getter and a low alpha tin anode), the sacrificial getter metal (tin) is not physically touching, electrically connected to, or otherwise in chemical communication with the anode, except through ionic connection via the electrolyte; the getter material is exposed to the electrolyte that is exposed to the anode. The getter metal of the getter apparatus is not an anode and is not used as an anode at any time, even though the two may be located in the same chamber, or exposed to the same electrolyte. The two elements (anode and passive getter) in the system and do not function the same. They are differentiated in that the passive getter it is not connected to the plating electrical circuit and its electrical potential is allowed to float at the local electrochemical potential in the solution at the physical position in the system. That potential at the getter surface relative to the anode may be modulated by the applied current through the cell, though there is no external circuit for any current to pass into or out of the passive getter.

The gettering process example, $Sn_{getter}(s)+2Ag^{+}\rightarrow Sn^{2+}+2Ag(s)$, is the same chemical reaction that would otherwise occur with the active Sn anode, leading to passivation, but the role of the getter is to have that process preferentially occur on the getter electrode. To that end, design variables for the getter assembly include the location of the getter (placement within the cell and relative to the anode and within the SAC system), flow distribution within and/or around the getter, and the getter's physical shape, form factor, total mass and composite particle size, and several other factors influencing the available interfacial surface area.

In some implementations, the physical form for the getter is one whose surface area is greater than that of the anode, for example about 2 times or more greater, or about 10 times or more greater, than the anode. To achieve this, getters (passive or active) may be designed to maximize the surface-area-to-volume of the getter material. This may be accomplished by, for example, providing the getter material in the form of granules, large particles (e.g., about 100 um or larger diameter), small pellets, fine mesh or wires, and highly porous sintered metals. These same characteristics may be applied to active getter materials (e.g., silver) which are described below. A very large effective surface area maximizes the gettering chemical or electrochemical reaction rate and success of complete or near complete gettering within minimal fluidic passes and before reacting with the anode.

Figure 3:
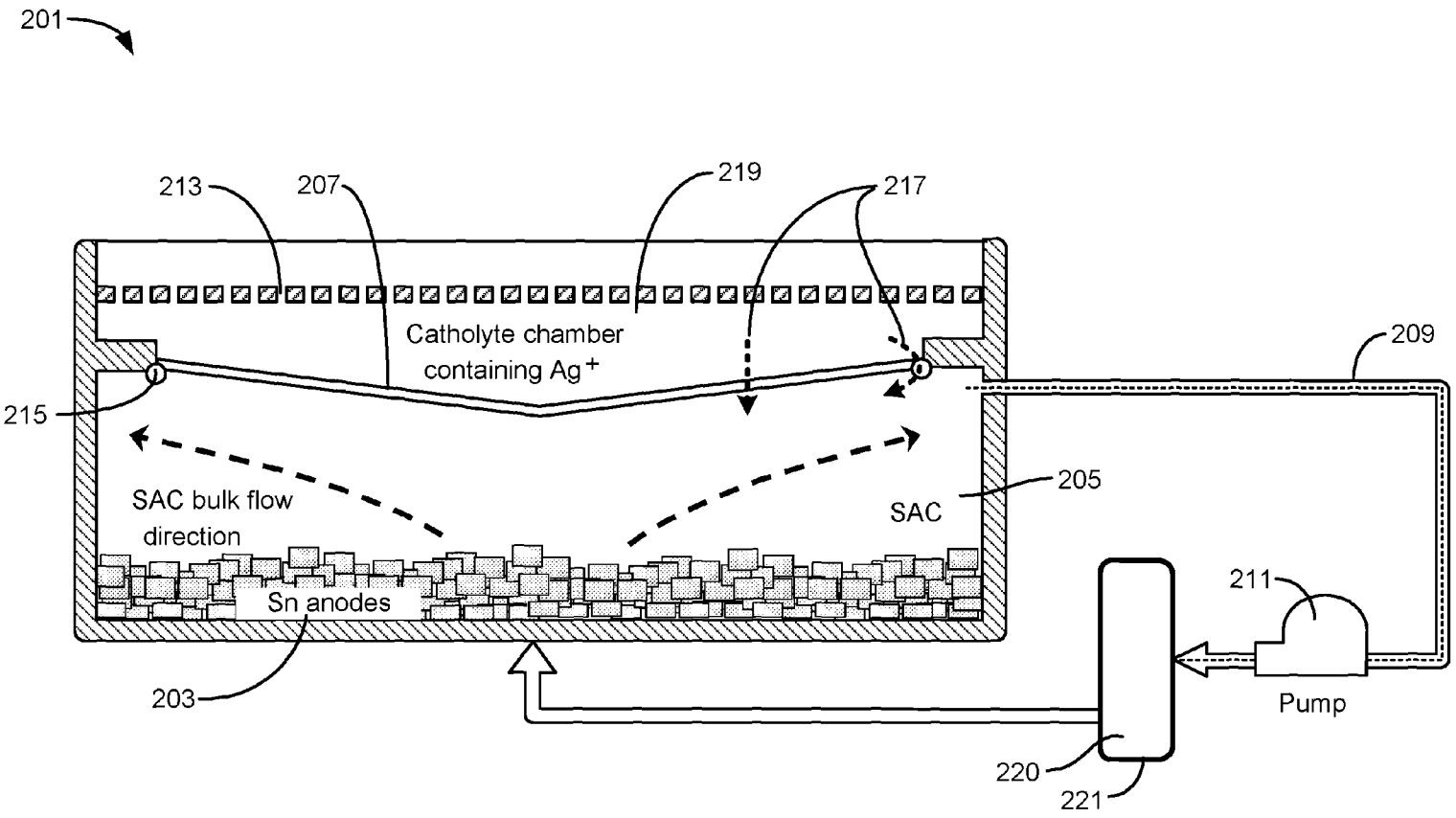
FIG. 3 is a cross-sectional schematic view of an embodiment of electroplating cell as in FIG. 2 but with a silver ion getter provided in an anolyte recirculation loop.

In one embodiment, as depicted in FIG. 3, the getter 220 is housed within a cartridge 221 and is located in a SAC fluidic recirculation loop 209. The SAC fluid recirculation loop may include a pump 211, the getter (passive or active type) and appropriate getter assembly/containment/housing/cartridges, an integrated or a separate particle filter element or cartridge, a valved inlet (not shown) for SAC fluid dosing and makeup, an overflow or other means (not shown) not in electrolytic connection but suitable for periodically transferring mechanically anolyte (for example during SAC Dosing) to a main bath either directly or indirectly to the catholyte region of the cell, a tube or other device (not shown) to regulate and maintain the static pressure in the SAC compartment and on the SAC membrane, an anolyte reservoir, and appropriate fluidic tube connections (e.g., an inlet and an outlet to the SAC 205). Some designs have the getter in a housing or cartridge that is easily accessible for replacement, determined by the unit's typical service life. The flowrate of the SAC recirculation loop can also be optimized by balancing the operational requirements (e.g. anode requirements) and the gettering needs.

Figure 4:
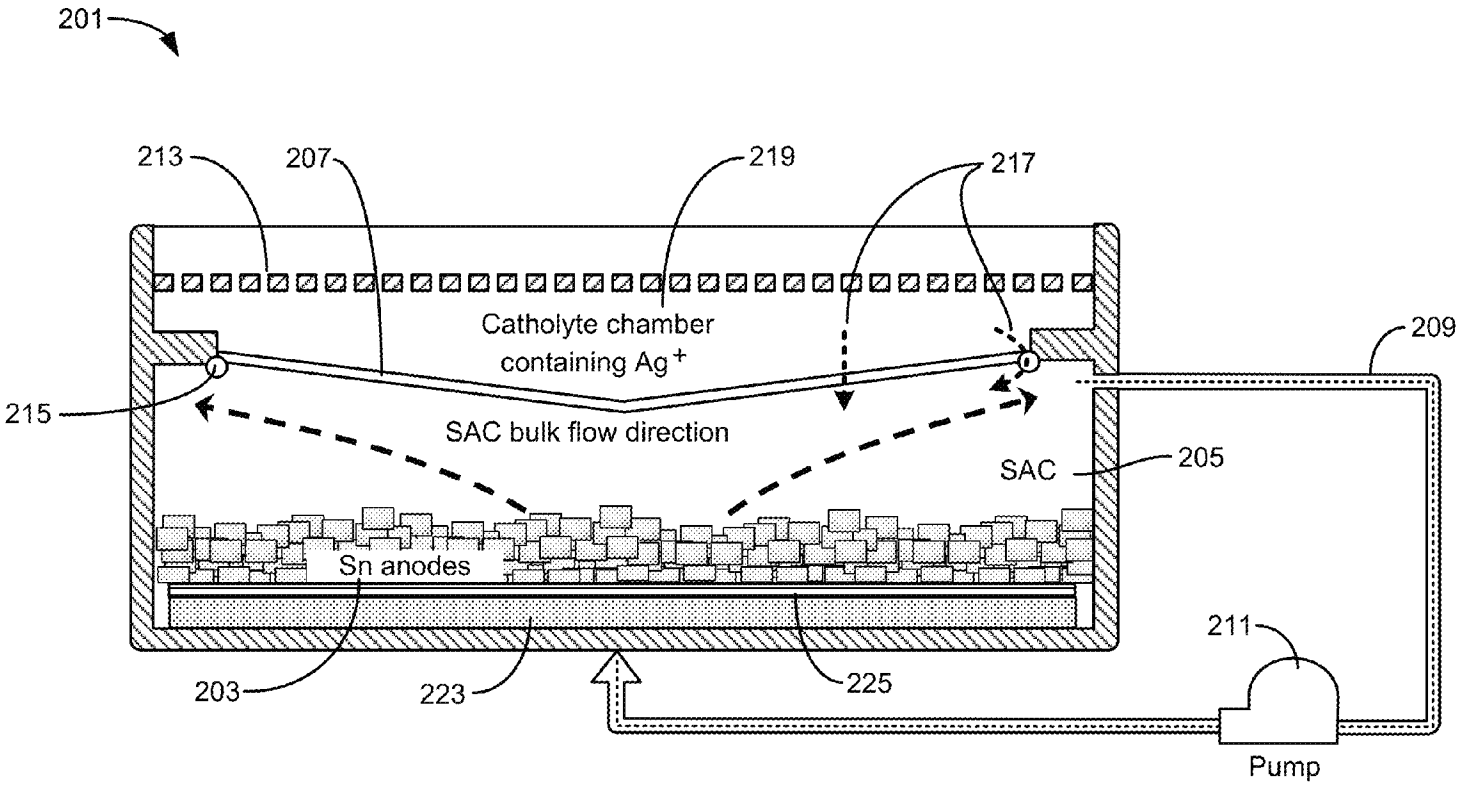
FIG. 4 is a cross-sectional schematic diagram of electroplating cell as shown in FIG. 2 but with a silver ion getter provided beneath a tin anode structure in a separated anode chamber of an electroplating cell.

In another embodiment, the getter is situated within the SAC compartment 205 and is placed below the tin anode 203. This configuration is illustrated in FIG. 4 in which the electroplating cell includes a SAC getter 223. In certain embodiments, the getter is not electrically connected to the actual anode tin anodes. Electrical separation can be through a dielectric spacer 225, with an electrical feed-through for the tin anode above. To ensure uniform anolyte flow through the getter, one can incorporate a manifold designed into the cell's anode chamber with upwards-radial and -azumuthal uniform flow distribution characteristics. A manifold design such as that described above for flowing anolyte uniformly over the anode can be employed.

The anode to getter spacer material can be made to be porous, perforated or with flow exit paths around the perimeter, to allow flow exit path to the remaining SAC compartment above. Alternatively, if the anode is monolithic and/or if flow though the anode is not required, the spacer and electronically isolating material may be a sheet of dielectric material. These embodiment and approaches have the advantage of utilizing the significantly larger volume in the SAC cell to maximize the gettering process by virtue of larger volume.

As one particular exception to the above, one embodiment provides an apparatus similar to FIG. 4, but with the getter and the anode electrically connected. In some cases, the getter and anode are combined as a single unit or element. As an example, the anode may be a monolithic piece of Sn, which can be placed in contact with or bonded to a porous high surface area getter section of the combined anode/getter. In this combined embodiment, the lower section of the element, the getter, resides furthest away from the cathode and "beneath" the active anode. It may be a high surface area (e.g., be porous) section of the plated less-noble metal, though through which anolyte is able to flow and be forced upwards and through it. The anode, preferably a non-porous solid piece of anode material, bounded to, or just physically sitting on, the getter element electrically shields the dissolution of both the getter and any less noble metal that is deposited onto the getter by displacement. Electrical current can pass through the getter to the anode and to the anode exposed upper surface. In certain embodiments, the relative amounts of getter and anode materials are chosen so that the end of life of the anode/getter composite is prior to the exhaustion all the low-surface area anode (which would result in the getter portion of the element being exposed). Consumption of the anode can be monitored for replacement by tracking the amount of charge passed though the cell. Typically, the surface area of the getter should be at least 5 times, more typically 10 times, that of the initial surface area of the anode.

Figure 5:
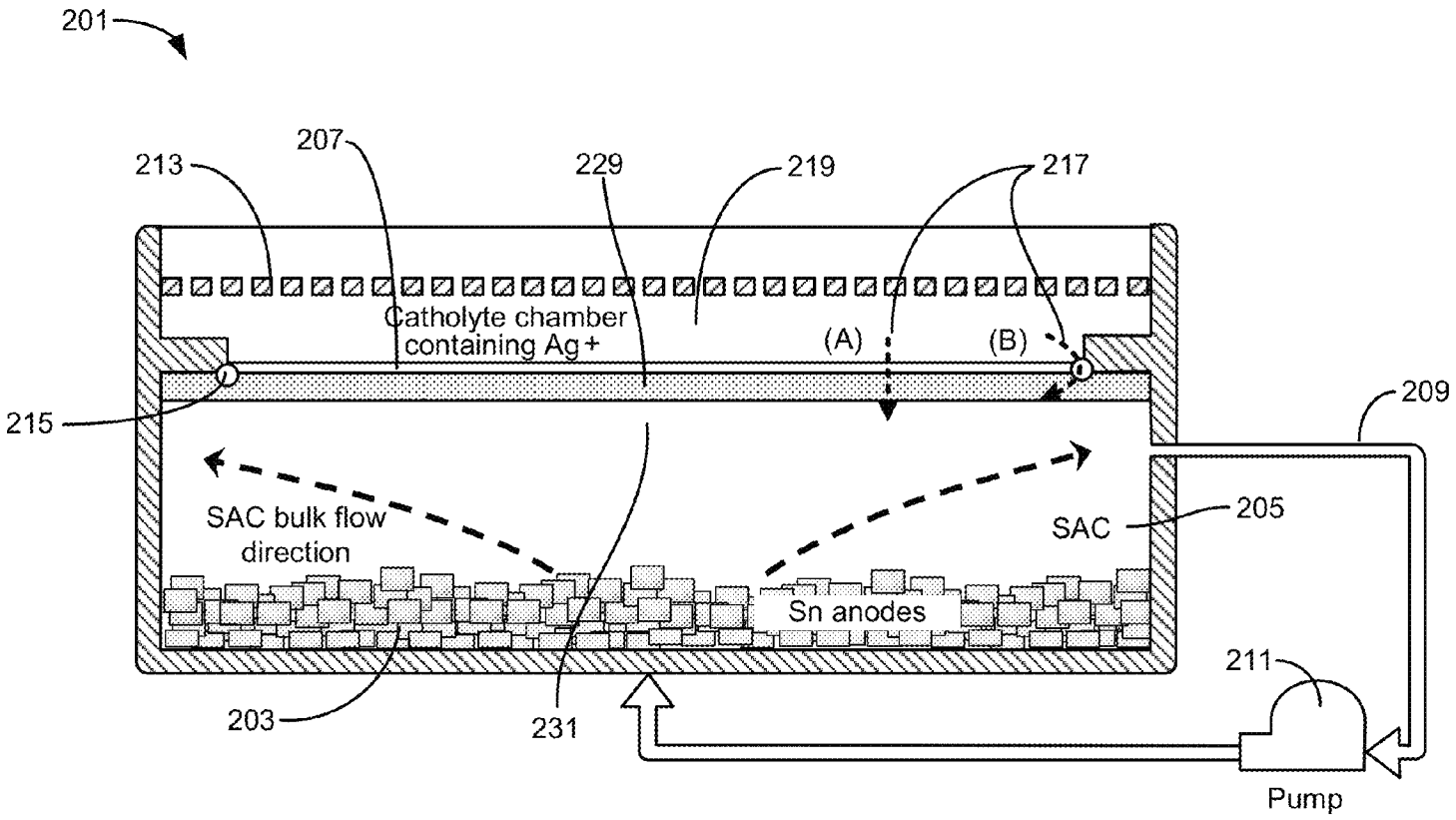
FIG. 5 is a cross-sectional depiction of the electroplating cell as in FIG. 2 but with a silver ion getter provided underneath a separator structure in a separated anode chamber of the electroplating cell.

Another embodiment is depicted in FIG. 5. This embodiment recognizes that the $Ag^{+}$ 'leakage' into the SAC compartment often comes from the upper chamber (diffusion across the CEM) and at areas where the sealing is incomplete or marginal, such as at the membrane-to-o-ring seal interface 215 that is less than perfect. In this embodiment, a getter element 229 is located at the upper-most section of the SAC compartment 205, just below (and sometimes contacting) the ion selective membrane 207. The getter element 229 may be filled with the high surface area getter. The lower portion of the getter element interfaces with the SAC compartment electrolyte through, e.g., a flow resistive membrane 231 such as a small-pore supporting medium. The small pores impede bulk flow to, from and between the getter element and the remaining SAC compartment. As a result, in such embodiments, the local fluid in the getter element 229 is largely stagnant with little or no bulk mixing between the electrolytes. The supportive membrane or porous medium 231 is ionically conductive and is not significantly diffusion restrictive. Normally, it will be compatible with the electrolyte. Examples include various types of filter membrane material (polyethylenesulfone, polyproylene, etc.), sintered glass, and various types of porous ceramic. Typically, the primary mode of mass transport within the getter chamber is by diffusion, and hence the $Ag^+$ that manages to transport across from the catholyte chamber membrane or leak in from above, will experience a very long residence time in the getter element 229, increasing the likelihood of reaction with the getter. This method has the advantage of providing a 'first in path' getter. This, along with the local long residence time, helps ensure the $Ag^+$ is fully reacted away in the getter chamber.

It is possible that when the cell is operating or plating, an indirect corrosion phenomena of the getter material may occur. If there is an electric field in the cell such that the lower section of the getter is at a more anodic (positive potential) than the upper half, this in the long term can result in the lower section of the getter slowly dissolving out $Sn^{2+}$, and the upper section re-plating tin on it. To minimize this impact, one approach is to make the getter thin, and in some embodiments be composed of a multiple thin laminates of electrically isolated layers, each having a porous membrane separating it from the next sections. In this manner, there is no net consumption or generation of the getter by corrosion, and a favorable process of self-regeneration of new tin surface, available for silver gettering, can occur, extending the life of the getter.

Figure 11:
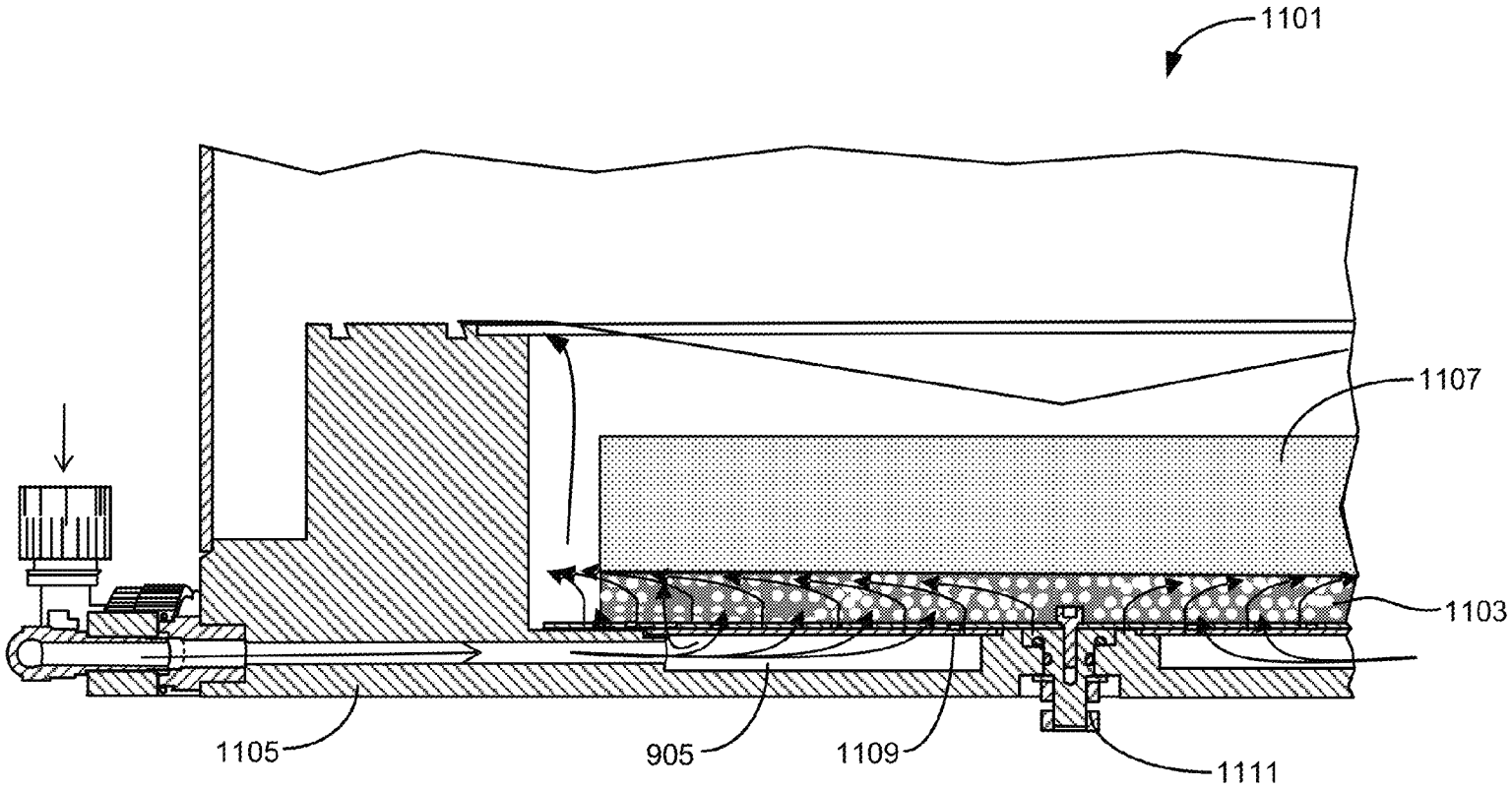
FIG. 11 is a cross-sectional view of a separated anode chamber containing a tin porous getter element disposed below a tin segmented solid anode.
Figure 12:
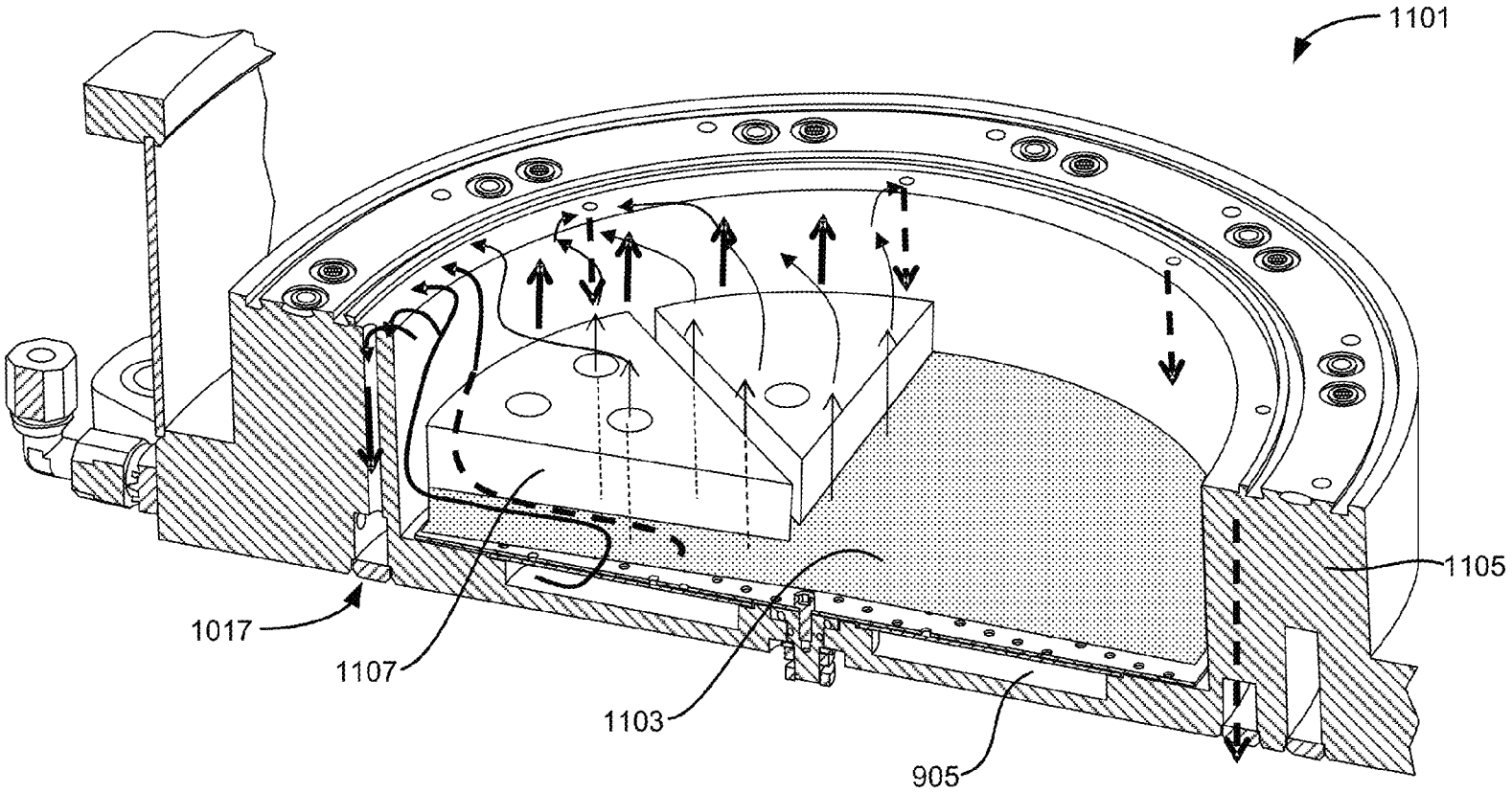
FIG. 12 is an isometric view of the separated anode chamber of FIG. 11.

FIGS. 11 and 12 depict a type of passive-gettering assembly 1101 where a getter 1103 is housed within a SAC compartment 1105 below a largely solid low surface area anode 1107. The anode shown (FIG. 12) is segmented in various pie or wedge shaped elements which also optionally contain some through holes therein. The gaps between the wedges and the holes therein allow a small amount of electrolyte to pass around the anode and irrigate the front surface of the anode, allowing stannic ions dissolved there to be removed. But the mostly solid form allows the majority (but not all) of the fluid emanating from the bottom of the cell's SAC porous flow distribution element 1109 to be blocked by the bottom of the wedges and diverted around the wedge shape anodes.

As shown in FIGS. 11 and 12, the high surface area porous low alpha tin getter element 1103 is situated between the SAC porous flow distribution element 1109 and the porous titanium charge plate 1011 (shown in FIG. 10). Silver ions in the electrolyte therefore are exposed first to the high surface area getter 1103 and flow though the element uniformly, extracting the silver ions from the solution effectively before that same flow will be exposed to the critical front surface of the wedge shaped largely solid anodes. The porous high surface area getter 1103, being made of metal (e.g., tin) also allows for the conduction of electrical current to the porous titanium anode charge collection plate, and through an electrical feed through 1111 of the cell. The weight of the wedge anodes is generally sufficient to establish good electrical contact to the assembly. The porous getter 1103 may be, for example, an assembly of small objects such as a pile or layer of small spheres or short rods, or a sintered structure combining smaller elements into an appropriate disk shape, the latter structure allowing for easy installation, removal and handling.

As shown in FIGS. 11 and 12, the getter 1103 is located below the solid anode 1107. Below in this context means further removed from the cathode in the direction of the cathode (wafer) to the anode. In such a position, the uppermost layers of the anode will tend to corrode with considerable selectivity over any metal that is further away from the cathode. Therefore, the side and the back of the anode 1107, and the entire getter 1103 as configured in FIGS. 11 and 12 (where the cathode not shown is above the anode) are largely shielded from the electric field established when passing current between the front face of the anode and the cathode. Any small deposition of silver that occurs on the front face of the anode will be undercut and not block the passage of current from the anode. Eventually, the anode 1107 will be entirely consumed and will need to be replaced. If the getter 1103 has not been exposed to significant quantities of silver ion during the period of use of the anode, it can be reused. Alternatively, if some silver metal plating on the getter is known or expected to have occurred, the getter 1103 (e.g. tin with silver on the surface of the getter) can be re-activated and replenished for subsequent used by carefully etching the surfaces of the unit. Placing the unit in a suitable etchant that can simultaneously remove both the more noble and less noble metal for a short period of time can be effective. In the case of a tin getter that has accumulated silver on its surface, placing the getter in a solution of approximately 15-30% nitric acid for several minutes (e.g. 2-10 minutes), followed by a thorough rinsing of the getter with water, can allow it to be reused several times.

Active Gettering

In the active gettering concept, an electrolytic process for removal of noble metal ions is driven by (1) an auxiliary low voltage power supply connecting the getter electrode to the anode with the getter polarized at, or slightly positive of (e.g. 50-400 mV positive) the anode potential, or (2) electrically connecting the getter element to the anode, either directly, or through a current controlling resistor. It should be understood that the counter electrode of the gettering electrode need not be the anode of the plating cell. In some embodiments, described more fully below and particularly with reference to FIG. 8, the counter electrode is not connected to the plating cell's anode and is closely associated with the gettering cathode. Sometime, the separate anode for gettering electrochemical cell is said to be a "local" anode.

In active gettering, a suitable material is used as an electrode to electrochemically remove unwanted contamination by reactive noble ions (e.g., $Ag^+$ ions) from the SAC compartment. An active gettering electrode is placed in the path of anolyte flowing, at least partially, toward the anode in the SAC compartment. In certain embodiments, the gettering electrode is provided in a separate chamber or compartment located outside the principal SAC region. See for example the schematic illustration of FIG. 6. In various embodiments, the gettering electrode is integrated in a pressure regulating device such as the devices described in U.S. patent application Ser. Nos. 13/305,384 and 13/051,822, each previously incorporated herein by reference in its entirety. Other examples of locations of the gettering electrode are described below.

Typically, the getter material is present in a quantity sufficient to remove the amount of noble metal ions conservatively expected to enter the SAC over an extended time period, e.g., at least about a day or at least about two days or at least about a week. Of course, these periods can vary depending on the throughput of the system and other factors. Typically, the active getter electrode has a surface area sufficient to remove a large fraction of the noble metal ions in the anolyte flowing through it. For example, the getter electrode may be designed to remove at least about 90% of noble ions flowing through it, or at least about 95% of such ions, or at least about 99% of such ions, or at least about 99.9% of such ions. The gettering electrode material may be relatively inert to the anolyte. Examples of suitable materials are presented elsewhere herein.

Figure 6:
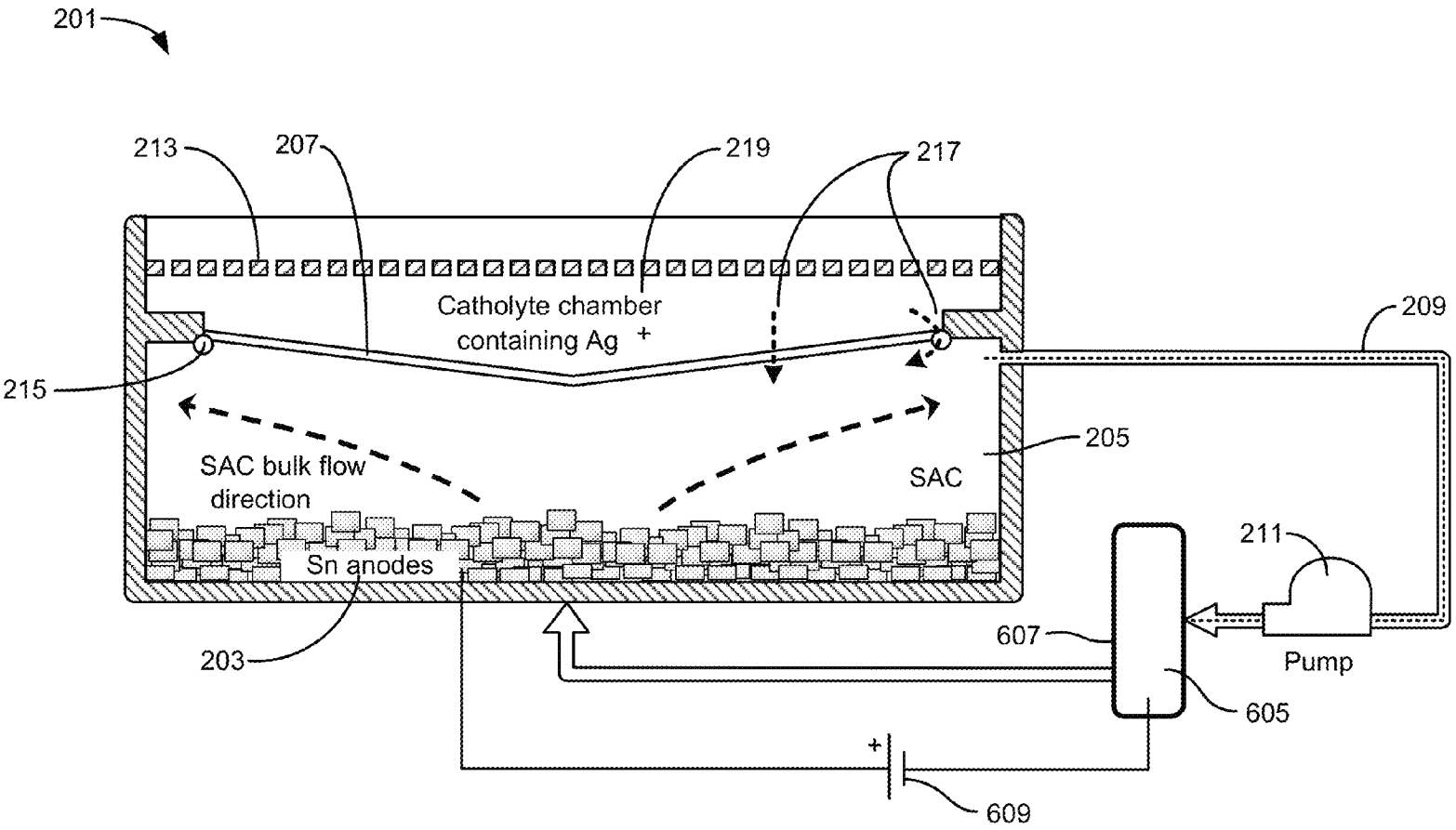
FIG. 6 is a cross-sectional depiction of the electroplating cell as in FIG. 3 but in which the getter in the anolyte recirculation loop is an active getter connected to a power supply.

In active gettering, the cathode getter may include a high surface area working cathode electrode. The electrode can be located within the anode chamber (e.g. below the anode). Alternatively, as illustrated in FIG. 6, a getter electrode 605 may be located in an auxiliary chamber 607 that has a connection-path of direct ionic communication with the anode, and is exposed to the circulation of the same electrolyte that the anode is exposed to (the anolyte of the separated anode chamber). In certain embodiments, the getter counter electrode (the anode) is made from the same material as the active anode (e.g., tin) in the SAC compartment that is used to supply metal ions and current for plating the work piece (wafer). Certain embodiments employ a power supply 609 to control the process. Such power supplies may operate the getter system in a potentiostatic mode, at a potential difference sufficiently negative to enable $Ag^+$ deposition, including silver ions of a complexed form, $Ag^+$—C, to plate onto the getter cathode, but at a potential sufficiently positive not to plate tin. In certain embodiments, the applied appropriate voltage to the getter will be in the range of between about 0 mV to +500 mV vs. the tin anode.

In a direct getter electrode connection method, a power supply is not used. Rather, the deposition of noble ions occurs by separating the spontaneous displacement reduction and oxidation processes to occur at two different locations. Silver deposition occurs at the getter electrode and tin dissolution occurs at the plating cell anode, which is electrically connected to the getter. The preference for the reaction to occur on the getter is driven by the higher surface area and, possibly, the lower kinetic resistance for plating on the purer metal of the getter (e.g. the presence of tin, from the anode, may kinetically impede or poison the rate at which silver ion reduction will occur on that surface, due to the formation of a heavy metal silver-metal alloy). Therefore, silver can be removed on a high surface area silver getter, and can drive tin metal ion dissolution for the anode. The potential for silver reduction will vary with silver concentration and the presence of silver complexer in the SAC compartment, but typically will be positive of tin reduction. So, rather than the tin corroding and electrons flowing though the anode to another location to complete the circuit and enable silver reduction, the electrons flow from the anode though an external lead spontaneously to the getter electrode, to reduce the silver there instead.

Anode: $Sn \rightarrow Sn^{+2} + 2e-$ (E~−0.13V)

Getter: $Ag^+ + e- \rightarrow Ag$ (E~+0.8 to +0.4V vs. NHE)

Net: $Ag^+ + Sn \rightarrow Sn^{+2} + Ag$ (Cell voltage~0.53 to 0.93V)

While the process can occur by simply shorting the anode and getter electrode (and even having the high surface area getter electrode in physical contact directly with the anode), in certain embodiments, the electrode getter is provided in a separate, easily removable and changeable element such as a cartridge.

The passage of current and charge between the anode and the getter is related to the amount (concentration) of noble metal, and a measure of the rate cumulated amount of silver removed. In certain embodiments, the current may be monitored to determine the concentration or change in concentration of the noble metal. In certain embodiments, the SAC is designed with (i) a separate housing for the getter allowing the anolyte to pass through the housing and return to the anode chamber, and (ii) an electrical connection between the electrochemical getter and the anode, which connection includes a calibrated resistor or similar device though which the current passing though the assembly can be monitored. Monitoring the current between the anode and the electrochemical getter allows one to detect catastrophic failure of the ion selective membrane, or some other source of leak, where a significant amount of silver enters the anode chamber. If left unchecked, a large concentration of silver in the anolyte can not only quickly passivate the anode, but it can also result in low silver plating on the wafer solder bumps, and a large change in plating uniformity. These conditions can dramatically lower the yield of high value wafers. Therefore, monitoring the current of the electrochemical getter of either the power supply regulated, or "shorted" configuration, may provide the added value of monitoring the life of the getter (time for replacement), and monitoring for cell catastrophic failure.

As mentioned, an added benefit to active gettering is that the ability to detect the presence of $Ag^+$ contamination in the SAC. This can be accomplished without the addition of significant additional equipment/components or setup. In the absence of $Ag^+$ contamination, there will be a low level of electrical current generated from the active gettering electrode, primarily driven by the reduction of oxygen when the getter potential is above ~0V NHE. As oxygen is reduced by the process, the current will decrease to a steady low value associated with the rate of oxygen uptake in the SAC. The process has been shown to be largely able to be stopped completely by keeping a nitrogen gas layer above the exposed portions of the SAC electrolyte. Depending on the source of the $Ag^+$ contamination, upon gettering, a peak or a sustained elevated current will flow through the electrical circuit. Thus, monitoring the current in this circuit will provide a direct indication of the presence of $Ag^+$ in the system and the gettering process.

Further, the reduction of dissolved atmospheric oxygen at the getter cathode provides an additional benefit. Low alpha tin electrolyte is expensive, and anything that can lower the operational cost will be of benefit. Using a tin active anode system lowers the cost and required use of low alpha tin electrolyte, but it generally cannot eliminate its use entirely. In addition to the strong inhibition of heavy metals like tin to water and proton reduction to form hydrogen, tin metal is reasonably stable in very strong acid despite its reduction potential being more negative than hydrogen formation. Also, because tin is a catalytically-poor oxygen reduction material, corrosion of tin by the reduction of oxygen is also largely inhibited. But the same statements are not true for silver or many other more noble metals. Therefore, the high surface area getter electrode can not only drive the reduction and removal of unwanted silver, but can also remove dissolved oxygen and drive the formation of hydrogen thereupon. Hence, the separation of the following cathodic and anodic processes between the catalytic getter electrode and the tin anode, allow for the spontaneous, and largely continuous, "free" formation of low alpha tin electrolyte from the low alpha tin anode.

Ag Getter Cathodic Reactions $Ag^+ e- \rightarrow Ag$ (E~+0.8 to +0.4V vs. NHE)

$2H^+ + 2e- H_2$ (E~0V vs. NHE)

$O_2$ (dissolved)$+4H^+ + 4e- 2H_2O$ (E~+0.6V vs. NHE, 8 ppm $O_2$)

Sn Anode Anodic Reaction $Sn \rightarrow Sn^{+2} + 2e^{-}$ (E~−0.13V)

Suitable getter electrode materials include noble or semi noble metals, including but not limited to, silver, platinum, palladium, gold, iridium, osmium, ruthenium, osmium. Alternatively, less noble metal may be used to save cost. These may also be more easily manufactured into a high surface area form. In choosing these electrode materials, one should consider the requirement of avoiding corrosion of the base metal in the solution and that the material should be more noble than the anode metal, i.e., have a reduction potential positive of tin. One example is the use of copper screen, foam or mesh, particularly when its surface is coated and/or treated (e.g. by plating) with silver.

Physical form factors leading to high surface area are preferred for similar reasons to the passive method: to help maximize the success of complete gettering or near complete gettering within minimal fluidic exposure and fluid passes. These physical form factors, include, but are not limited to, foils, granules, large particles, small pellets, fine mesh or wires, and highly porous sintered material.

Similar to the passive gettering, the active gettering electrode can potentially be placed at various places in the SAC system. In a preferred embodiment, but not limited to, the gettering electrode is placed in a separate housing that is part of the SAC fluid recirculation, as depicted in FIG. 6.

In one embodiment the active gettering electrode can be constructed somewhat akin to a cartridge, allowing fairly easy replacements. In addition, the lifetime may be quite predictable by tracking the total amount of charge gettered by the gettering electrode. But to avoid internal corrosion of the getter under the influence of a gradient of potential within the anode chamber and cell, the getter should not generally be located or placed such that the extremities of the getter assembly are subjected to a substantial potential difference. Therefore, in one embodiment, the getter is housed between the anode and cathode and is substantially designed to be thin as possible and follow a surface of isopotential contours, similar to that shown in FIG. 5. In another example, the getter is "below" or "behind" the anode. Here, below or behind means having a general location in the general direction from the cathode (wafer) and the anode, and further removed from the cathode than the anode, as shown in the position of the getter of FIGS. 4, 11 and 12. This location behind the anode produces very small gradients in cell potential because there are few line of current passing though this circuitous route, and because the metallic anode "above" the getter shields the region. In another getter location, the getter and any associated assembly is located and housed in an flow-through auxiliary chamber or fixture, connected ionically and fluidically to the main chamber of the cell between the anode and wafer through a pipe or tube. Very little current will pass though this circuitous auxiliary ionic current flow path, and therefore no potential gradients will exist to corrode the getter electrode during operation of the cell.

In the active getter embodiments described so far, the getter is electrically connected to the plating cell anode. In other words, the plating cell anode serves as the counter electrode to the getter working electrode or cathode. In other embodiments, a separate counter electrode is provided for the active getter cell. This separate electrode is an anode that is distinct from the plating cell anode. In some embodiments, the separate counter electrode is located relatively close to the getter electrode, at least in comparison to the location of the plate cell anode. The proximity and other features of the separate counter electrode may be chosen to promote current flow between it and the getter electrode, with relatively little current flowing between the getter electrode and the plating cell anode.

In certain embodiments, the getter cell with separate anode is housed in its own chamber, separate from the SAC compartment. In one example, the getter cell chamber is implemented as a flow through assembly having both a silver extracting cathode and a local counter electrode which is also a source of low alpha tin (to prevent corrosion and enable the assembly to be shielded from field-induced corrosion). Certain implementations of a separate getter cell are depicted in FIGS. 7 and 8. In the embodiment of FIG. 8, the getter electrode and the counter electrode are sheets wrapped together as a jelly roll. In certain embodiments, the "gettering electrochemical filter" fits in a pressure regulating element of the SAC. Overflowing SAC electrolyte in this element creates a fountain, which passes though the highly porous filter or mesh that keeps the electrode electrically isolated, and then accumulates at the base of the pressure regulating element to exit through the element's drain. The drain feeds to the inlet of the SAC recirculation flow pump. See FIGS. 7 and 8.

Figure 7A:
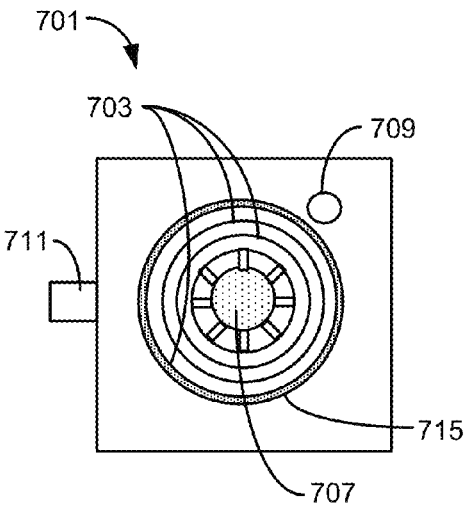
FIGS. 7A and 7B schematically depict an active getter structure containing a wound high surface area silver filter.
Figure 7B:
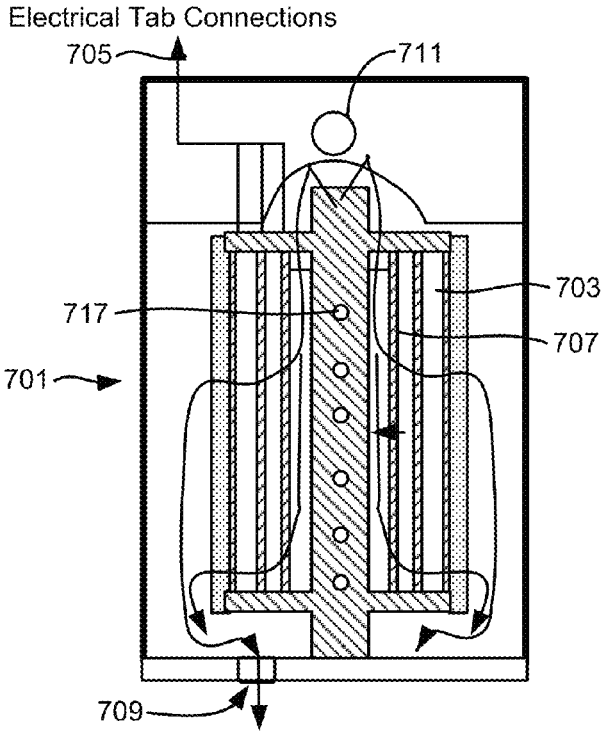

FIG. 7A presents a top view a wound getter structure 701 and FIG. 7B presents a side view of the same structure. A principle component of this getter is a wound high surface area sheet 703 that acts as a filter for the anolyte. This jelly roll structure may be held in a coarse particle filter 715 such as a "sock" type filter. The wound filter contains a cathodic getter material electrically connect to a counter electrode through, for example, a tab connection 705. Anolyte flows into structure 701 through a central open flow cavity in a perforated tube 707. Anolyte flows laterally out of the perforations in tube 707 and through the wound getter 703 to remove, e.g., silver ions. In the depicted embodiment, tube 707 has a fluted design with a series of cross flow feeder holes 717. Anolyte that does not make it out of the lateral holes in tube 707 flows out of the top of the tube and into the interior of the getter structure 701. Some or all of this overflowing anolyte passes through wound getter 703. The filtered anolyte flows out of an outlet hole 709 in the bottom of structure 701. If the fluid flowing out of tube 707 accumulates too rapidly, it may flow out of an overflow tube 711 near the top of structure 701. The overflowing anolyte may be directed back to the anolyte. In some embodiments, the tube and wound getter are unit that can be removed and replaced in the getter structure 701.

Figure 8A:
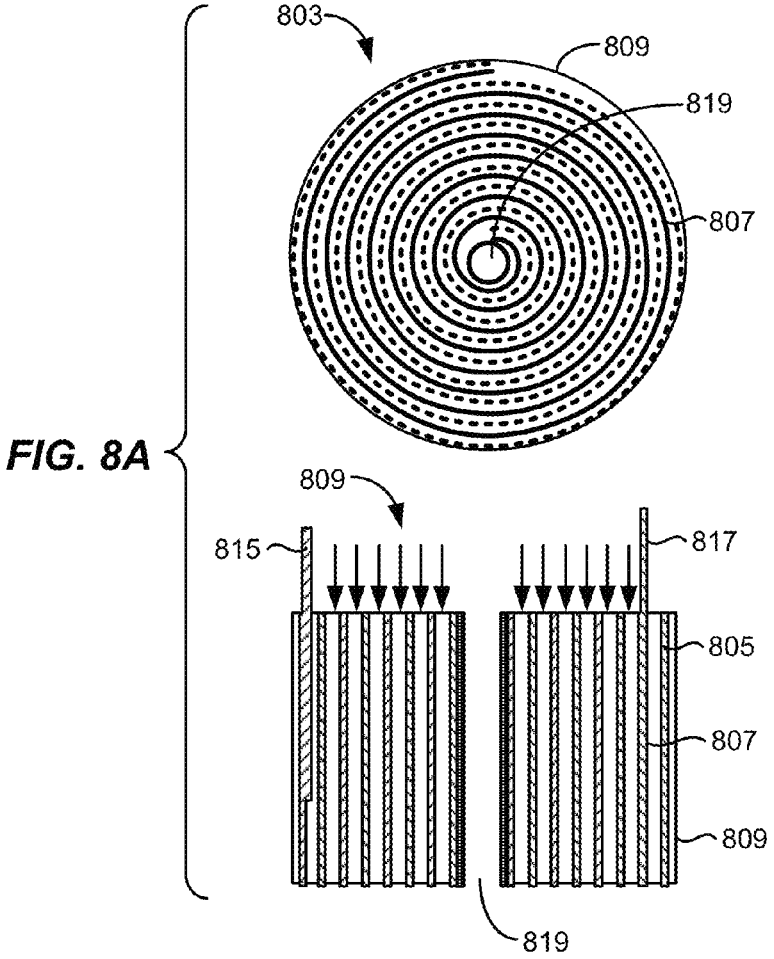
FIGS. 8A and 8B depict a noble metal getter with a jellyroll assembly including an internal anode and an internal cathode.
Figure 8B:
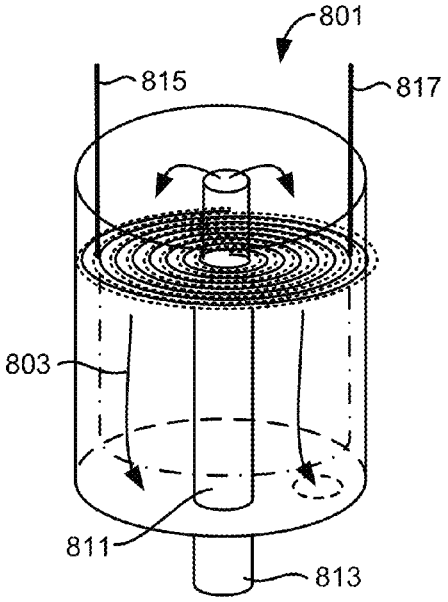

FIGS. 8A and 8B present another embodiment of a separate flow through active getter cell assembly 801. FIG. 8A shows cross-sectional top and side views, and FIG. 8B shows a perspective view. In this embodiment, a jelly roll assembly 803 includes both a wound anode layer 805 and a wound cathode layer 807. It also includes an electrically insulating separator layer 809 between the anode and cathode layers. In operation, anolyte flows through jelly roll assembly 803, e.g., from top to bottom as shown in FIG. 8B, and serves as an ionically conducting electrolyte for the active getter cell. Jelly roll assembly 803 may be wound about a central mandrel to leave a central axial opening 819. In certain embodiments, an anolyte inlet tube 811 is provided in the central axial opening. Anolyte flows into tube 811 through an inlet 813, up through the full height of the tube, and out the top of the tube as depicted in FIG. 8B. Anolyte flowing out of tube 811 then flows down through jelly roll assembly 803 where the active getter removes silver ions or other noble impurity. Anode layer 805 is connected to a negative terminal via, e.g., an anode electrical connection tab 815. Similarly, cathode layer 807 is connected to a positive terminal via, e.g., a cathode electrical connection tab 817.

Silver Ion and Leak Detection Probe

Figure 13:
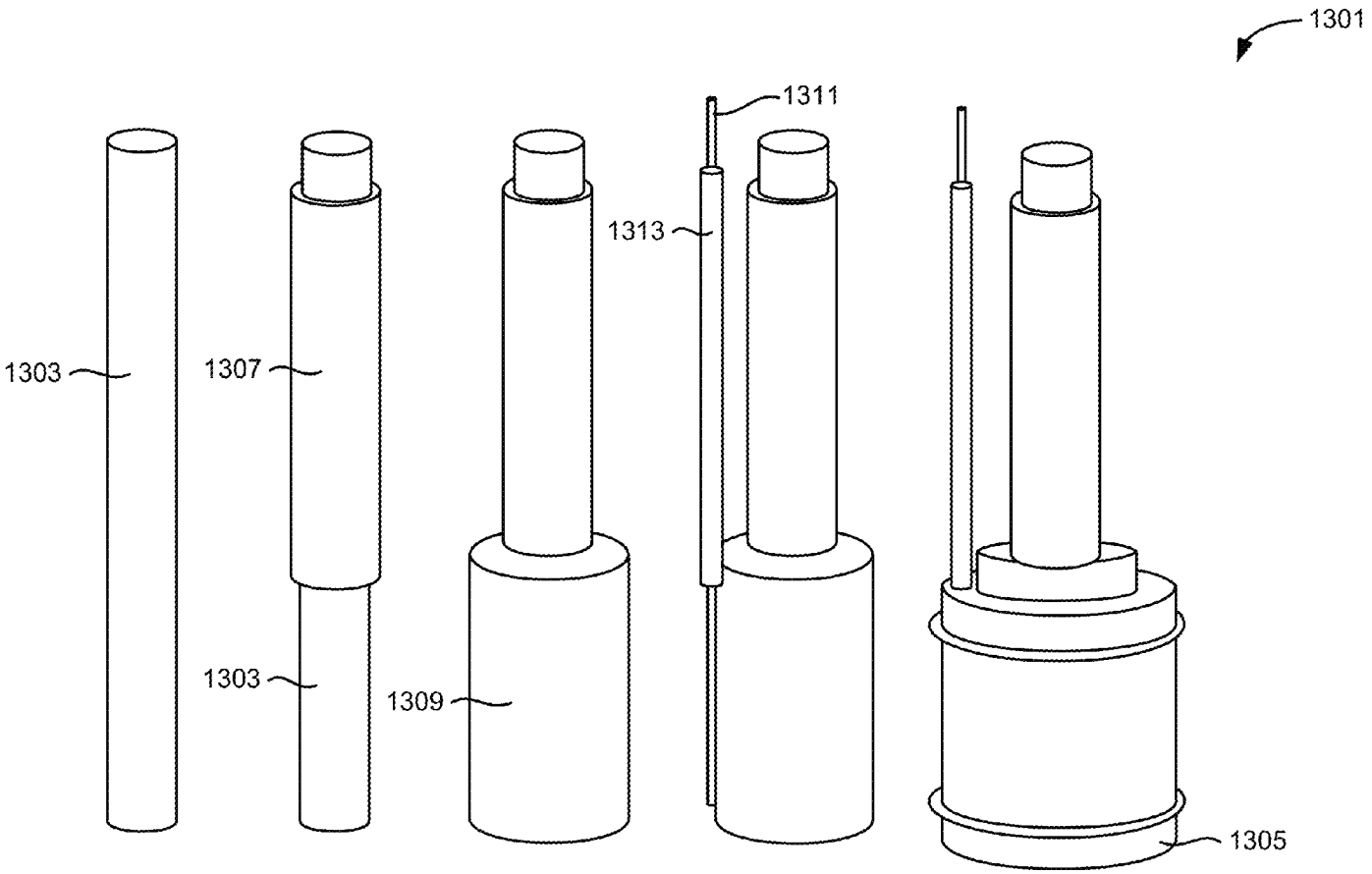
FIG. 13 depicts a silver ion concentration or leak detection probe at various stages of fabrication.

In some embodiments, a silver ion presence and anode chamber leak detection probe are used (SILD probe). One embodiment of a silver ion leak detection probe 1301 is shown in FIG. 13. The probe contains a anode of the primary non-noble metal being plated (e.g., Sn or low alpha tin) 1303 and a cathode 1305 suitable for reducing any dissolve noble metal that may have entered the separated anode chamber (SAC). The two electrodes are electrically isolated from each other within the SAC or in a different chamber ionically connected to the SILD probe, and are both exposed to anolyte around and have anolyte between them. In one embodiment, the SILD probe contains a centrally located anode made of a low alpha tin rod that has a portion of the rod covered with an electrically insulating chemically compatible sheath 1307. The lower portion of the rod is surrounded by a porous member 1309, such as a wrapping of a membrane or a shaped sintered plastic or glass into which the bottom of the tin rod fits. In use, the porous member contains electrolyte (e.g., anolyte solution). Around the porous member is the cathode used to detect the presence of silver ions in the anolyte, such as a sintered sheet of silver powder, or silver foil, of a wrapping of wire. The cathode has a cathode lead 1311 that may be coated with an insulator 1313.

The probe can be used to detect the amount of silver in a solution, or to warn of an unexpected high level of silver in the SAC compartment. The mode of operation in doing so can be varied, and just a few are mentioned here to clarity. In one mode of operating the leads of the device are connected to a power supply designed and suitable to maintain the potential between the two leads at a fixed potential. The potential between the leads may be held between approximately 0 V and 500 mV, with the silver detecting lead being held at the more positive potential. Current passing though the power supply and the SILD probe is then monitored by various common known means (e.g., and inductive or DC current meter, voltage across a resistance or a known value, etc.). In an alternative embodiment, the two leads of the SILD probe are connected together with a resistor of a known resistance, typically a quite low resistance that offer minimal resistance to the flow of current relative to the impedance of the device in the test solution. The impedance of the device depends on the size and surface areas of the electrodes of the SILD and the anolyte's conductivity, but typically a value of between about 10 ohm to 1 ohm will be suitable to measure a voltage across the resistance, and scale the current flowing between the SILD probes electrodes. The plating tool uses the SILD probe and monitors the voltage across the resistor or the current flowing though the SILD circuit, and is used to alert the operating system of a potential high level of silver in the anode chamber. With the cathode of the SILD held at a potential negative of the reduction potential of the silver (e.g. at or near tins reduction potential), any silver ion in the solution will be plated on the SILD cathode and the current can be measured. Anodic current is supplied to the SILD by the tin anode rod, generating stannic ions.

It should be noted that the various embodiments presented herein are not mutually exclusive, and most if not all, can in fact be implemented simultaneously, thereby increasing overall effectiveness and robustness of the system in removing the unwanted $Ag^+$ and hence protecting the tin anode of interest from passivation risk.

It is to be understood that the configurations and/or approaches described herein are exemplary in nature, and that these specific embodiments or examples are not to be considered in a limiting sense, because numerous variations are possible. The specific designs and methods described herein may represent one or more of any number of design and processing strategies. As such, various acts and features illustrated may be implemented as shown, such as in the sequence illustrated, or in other sequences, in parallel, or in some cases omitted. Likewise, the order of the above described processes may be changed.

The subject matter of the present disclosure includes all novel and nonobvious combinations and sub-combinations of the various processes, systems and configurations, and other features, functions, acts, and/or properties disclosed herein, as well as any and all equivalents thereof.

What is claimed is:

1. An apparatus for simultaneously electroplating a first metal and a second, more noble metal onto a substrate, comprising:

(a) an anode chamber for containing anolyte and an active anode, said active anode comprising the first metal;

(b) a cathode chamber for containing catholyte and the substrate;

(c) a separation structure positioned between the anode chamber and the cathode chamber and permitting passage of ionic current during electroplating; and (d) a getter comprising a solid phase getter material that undergoes a metal-metal displacement reaction or a selective ion exchange process when contacting ions of the second metal, wherein the getter is positioned to contact the anolyte but not contact the catholyte during electroplating, wherein the getter is positioned at a first distance from the cathode chamber and the active anode is positioned at a second distance from the cathode chamber such that the first distance is greater than the second distance, and wherein the getter is structurally distinct from the active anode.

2. The apparatus of claim 1, wherein the first metal is tin and the second metal is silver.

3. The apparatus of claim 2, further comprising a source of silver ions fluidically coupled to the cathode chamber.

4. The apparatus of claim 1, wherein the active anode comprises low alpha tin.

5. The apparatus of claim 1, wherein the separation structure comprises an ion selective membrane.

6. The apparatus of claim 1, further comprising an anolyte circulation loop fluidically coupled to the anode chamber and designed or configured to flow the anolyte through the anode chamber, wherein the anolyte circulation loop comprises said getter and said getter is located outside the anode chamber.

7. The apparatus of claim 6, further comprising a circuit for connecting the active anode to the getter.

8. The apparatus of claim 6, wherein said getter comprises a filter having a wound structure comprising the getter material, and wherein the filter is designed or configured such that the anolyte flows through the wound structure when in operation.

9. The apparatus of claim 1, further comprising an anolyte circulation loop fluidically coupled to the anode chamber through an anode chamber inlet and an anode chamber outlet, wherein the anolyte circulation loop is designed or configured to flow the anolyte through the anode chamber, wherein said getter is positioned between a location for the active anode and the inlet to the anode chamber, further comprising a spacer for separating the getter and active anode from physical contact during electroplating.

10. The apparatus of claim 1, wherein the getter material comprises low alpha tin metal.

11. The apparatus of claim 1, wherein the getter is electrically isolated from the active anode.

12. The apparatus of claim 1, wherein the getter material comprises particles with a surface area per volume at least about 2 times the surface area per volume of the active anode.

* * * * *